US008754817B1

(12) United States Patent
Kuo et al.

(10) Patent No.: US 8,754,817 B1
(45) Date of Patent: Jun. 17, 2014

(54) MULTI-MODE WIDEBAND ANTENNA

(75) Inventors: Jerry W. Kuo, San Jose, CA (US); Anuj Dron, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 213 days.

(21) Appl. No.: 13/314,095

(22) Filed: Dec. 7, 2011

(51) Int. Cl.
*H01Q 1/24* (2006.01)

(52) U.S. Cl.
USPC ..... 343/702; 343/700 MS

(58) Field of Classification Search
USPC ..... 343/702, 700 MS
See application file for complete search history.

(56) References Cited

U.S. PATENT DOCUMENTS 7,136,019 B2 * 11/2006 Mikkola et al. ..... 343/702
2006/0152411 A1 * 7/2006 Iguchi et al. ..... 343/700 MS
2007/0069958 A1 * 3/2007 Ozkar ..... 343/700 MS
2008/0129612 A1 * 6/2008 Wang et al. ..... 343/702
2010/0141536 A1 * 6/2010 Zhang et al. ..... 343/702

OTHER PUBLICATIONS

Anonymous. (Aug. 23, 2011). "Pulse Electronics Introduces Low Profile 700-LTE Switchable Antenna for Tablets," located at http://www.pulseelectronics.com/index.php?id=183&news_id=321, last visited on Oct. 10, 2011, 2 pages.
Li, W-Y. et al. (Date unknown). "Internal Small-Size PIFA for LTE/GSM/UMTS Operation in the Mobile Phone," 978-1-4244-4968-2/10 ©2010 IEEE, 4 pages.

* cited by examiner

*Primary Examiner* — Hoang V Nguyen
(74) *Attorney, Agent, or Firm* — Lowenstein Sandler LLP

(57) ABSTRACT

Methods and systems for extending a bandwidth of a multi-mode wideband antenna of a user device are described. A multi-mode wideband antenna includes a single radio frequency (RF) input coupled to a first antenna structure to provide a first resonant mode and a second resonant mode and to operate as a feeding structure to an antenna circuit that is not conductively coupled to the first antenna structure. The antenna circuit is configured to provide additional resonant modes of the multi-mode wideband antenna.

41 Claims, 18 Drawing Sheets

MULTI-MODE WIDEBAND ANTENNA

BACKGROUND OF THE INVENTION

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops, and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high band. One resonant mode in the lower frequency band and one resonant mode in the high band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union. Application services include wide-area wireless voice telephone, mobile Internet access, video calls and mobile TV, all in a mobile environment. The required frequency bands for 3G applications may be GSM850/EGSM in low band and DCS/PCS/WCDMA in high band. The 3G band is between 824 MHz and 960 MHz. Long Term Evolution (LTE) and LTE Advanced (sometimes generally referred to as 4G) are communication standards that have been standardized by the 3rd Generation Partnership Project (3GPP). However, in order to extend the frequency coverage down to 700 MHz for 4G/LTE application, antenna bandwidth needs to be increased especially in the low band. There are two common LTE bands used in the United States from 704 MHz-746 MHz (Band 17) and from 746 MHz-787 MHz (Band 13). Conventional solutions increase the antenna size or use active tuning elements to extend the bandwidth. Alternatively, conventional solutions use separate antennas to achieve different frequency bands and use a switch to switch between the antennas. These solutions are not conducive to use in user devices, often because of the size of the available space for antennas within the device.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION OF THE PRESENT INVENTION

Figure 1:
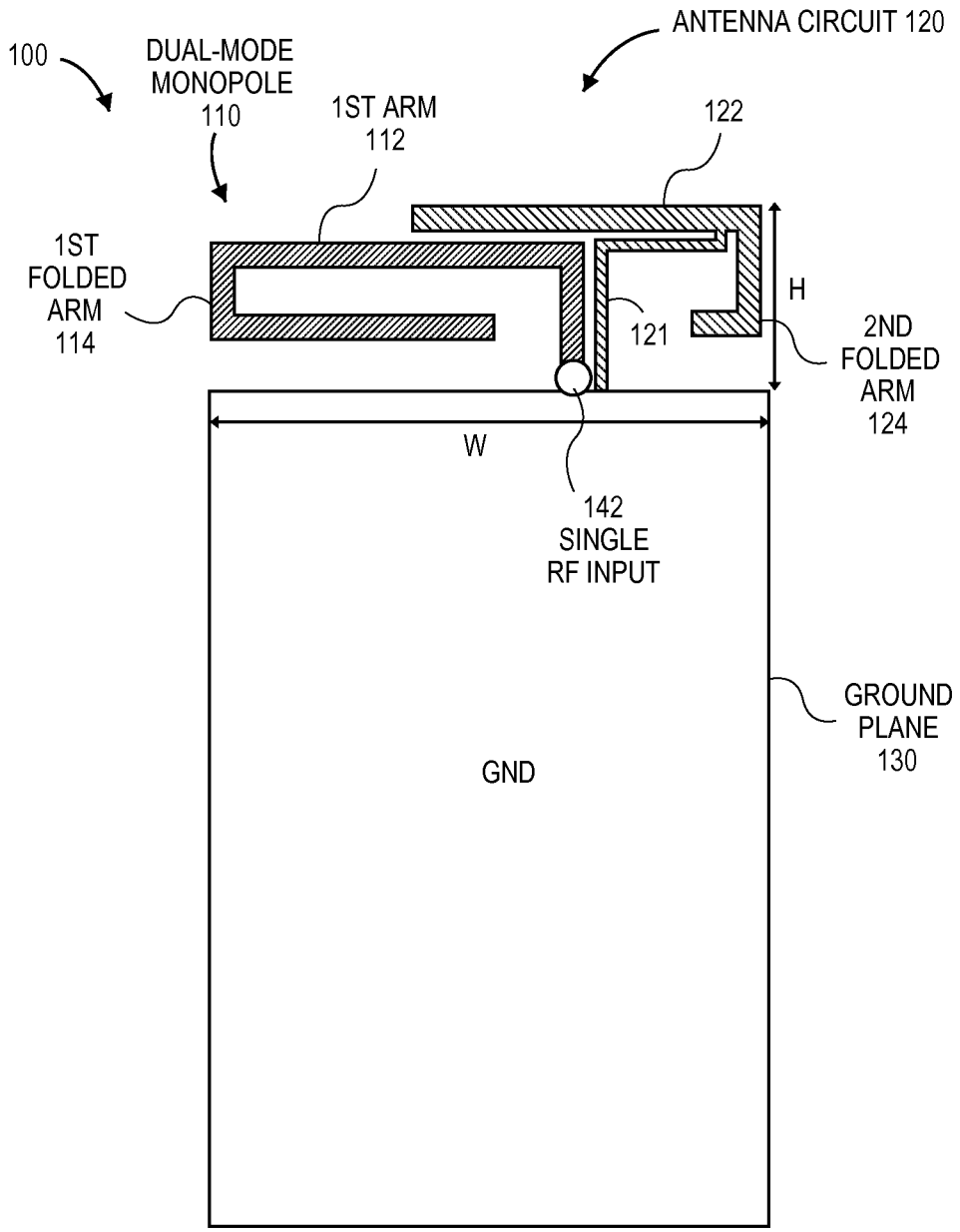
FIG. 1 illustrates one embodiment of a multi-mode wideband antenna including a dual-mode monopole antenna and an antenna circuit.

Methods and systems for extending a bandwidth of a multi-mode wideband antenna of a user device are described. A multi-mode wideband antenna includes a single radio frequency (RF) input coupled to a first antenna structure to provide a first resonant mode and a second resonant mode and to operate as a feeding structure to an antenna circuit that is not conductively coupled to the first antenna structure. The antenna circuit to provide additional resonant modes of the multi-mode wideband antenna. The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

As described above, the conventional antenna usually has only one resonant mode in the lower frequency band and one resonant mode in the high band. The embodiments described herein increase the bandwidth of the multi-mode wideband antenna by adding additional resonant modes, extending the frequency coverage. In one embodiment, the multi-mode wideband antenna extends the frequency coverage down to 700 MHz for use in 4G/LTE applications, as well as provides additional resonances in the high band. In one embodiment, a multi-mode wideband antenna is a dual-mode monopole antenna coupled to a single RF input, and the dual-monopole antenna operates as a feeding structure to a passive antenna structure disposed near the dual-monopole antenna. The multi-mode wideband antenna has a single RF input that drives the dual-mode monopole antenna as an active or driven element and the passive antenna is a parasitic element that is fed by the dual-monopole antenna. By coupling the dual-mode monopole and passive antennas, two resonant modes can be created in the lower band and two or more resonant modes can be created in the higher band. The proposed multi-mode wideband antenna uses two resonant modes to cover 700 MHz-960 MHz to cover the both the 3G band and the LTE band in a single RF input. The embodiments described herein are not limited to use in 3G and LTE bands, but could be used to increase the bandwidth of a multi-band frequency in other bands, such as Dual-band Wi-Fi, GPS and Bluetooth frequency bands. The embodiments described herein provide a multi-mode wideband antenna to be coupled to a single RF input feed and does not use any active tuning to achieve the extended bandwidths. The embodiments described herein also provide a multi-mode wideband antenna with increased bandwidth in a size that is conducive to being used in a user device.

FIG. 1 illustrates one embodiment of a multi-mode wideband antenna 100 including a dual-mode monopole antenna 110 and an antenna circuit 120. In this embodiment, the multi-mode wideband antenna 100 is fed at the single RF input 142 at the dual-mode monopole antenna 110 and the antenna circuit 120 is a parasitic element. A parasitic element is an element of the multi-mode wideband antenna 100 that is not driven directly by the single RF input 142. Rather, the single RF input 142 directly drives another element of the multi-mode wideband antenna (e.g., the dual-mode monopole 110), which parasitically induces a current on the parasitic element. In particular, by directly inducing current on the other element by the single RF input 142, the directly-fed element radiates electromagnetic energy, which causes another current on the parasitic element to also radiate electromagnetic energy, in multiple resonant modes. In the depicted embodiment, the antenna circuit 120 is parasitic because it is physically separated from the dual-mode monopole antenna 110 that is driven at the single RF input 142. The driven dual-mode monopole antenna 110 parasitically excites the current flow of the antenna circuit 120. In one embodiment, the antenna circuit 120 and dual-mode monopole antenna 110 can be physically separated by a gap. Alternatively, other antenna configurations may be used to include a driven element and a parasitic element. The dimensions of the dual-mode monopole antenna 110 and the antenna circuit 120 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another.

In FIG. 1, the ground is represented as the radiation ground plane 130. The ground plane 130 may be a metal frame of the user device. The ground plane 130 may be a system ground or one of multiple grounds of the user device. The RF input 142 may be a feed line connector that couples the multi-mode wideband antenna 100 to a feed line (also referred to as the transmission line), which is a physical connection that carriers the RF signal to and/or from the multi-mode wideband antenna 100. The feed line connector may be any one of the three common types of feed lines, including coaxial feed lines, twin-lead lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to dual-mode monopole antenna 110 of the multi-mode wideband antenna 100, but is not conductively connected to the antenna circuit 120 of the multi-mode wideband antenna 100. However, the dual-mode monopole 110 is configured to operate as a feeding structure to the antenna circuit 120.

In one embodiment, the multi-mode wideband antenna 100 is disposed on an antenna carrier, such as a dielectric carrier of the user device. The antenna carrier may be any non-conductive material, such as dielectric material, upon which the conductive material of the multi-mode wideband antenna 100 can be disposed without making electrical contact with other metal of the user device. In another embodiment, the multi-mode wideband antenna 100 is disposed on or within a circuit board, such as a printed circuit board (PCB). Alternatively, the multi-mode wideband antenna 100 may be disposed on other components of the user device or within the user device as would be appreciated by one of ordinary skill in the art having the benefit of this disclosure. It should be noted that the multi-mode wideband antenna 100 illustrated in FIG. 1 is a planar, two-dimensional (2D) structure. However, as described herein, the multi-mode wideband antenna 100 may include 3D structures, as well as other variations than those depicted in FIG. 1.

Using the dual-mode monopole 110 and the antenna circuit 120, the multi-mode wideband antenna 100 can create multiple resonant modes using the single RF input 142, such as three or more resonant modes. In one embodiment, the multi-mode wideband antenna 100 can be configured to create a resonant mode for LTE 700 plus penta-band. In telecommunications, the terms multi-band, dual-band, tri-band, quad-band, and penta-band refer to a device, such as the user device described herein, supporting multiple RF bands used for communication. In other embodiments, the antennas can be designed to cover an eight-band LTE/GSM/UMTS, the GSM850/900/1800/1900/UMTS penta-band operation, or the LTE700/GSM850/900 (698-960 MHz) and GSM 1800/190/UMTS/LTE2300/2500 (1710-2690 MHz operation. In the user device context, the purpose of doing so is to support roaming between different regions whose infrastructure cannot support mobile services in the same frequency range. These frequency bands may be Universal Mobile Telecommunication Systems (UMTS) frequency bands, GSM frequency bands, or other frequency bands used in different communication technologies, such as, for example, cellular digital packet data (CDPD), general packet radio service (GPRS), enhanced data rates for GSM evolution (EDGE), 1 times radio transmission technology (1xRTT), evaluation data optimized (EVDO), high-speed downlink packet access (HSDPA), WiFi, WiMax, etc.

Figure 11:
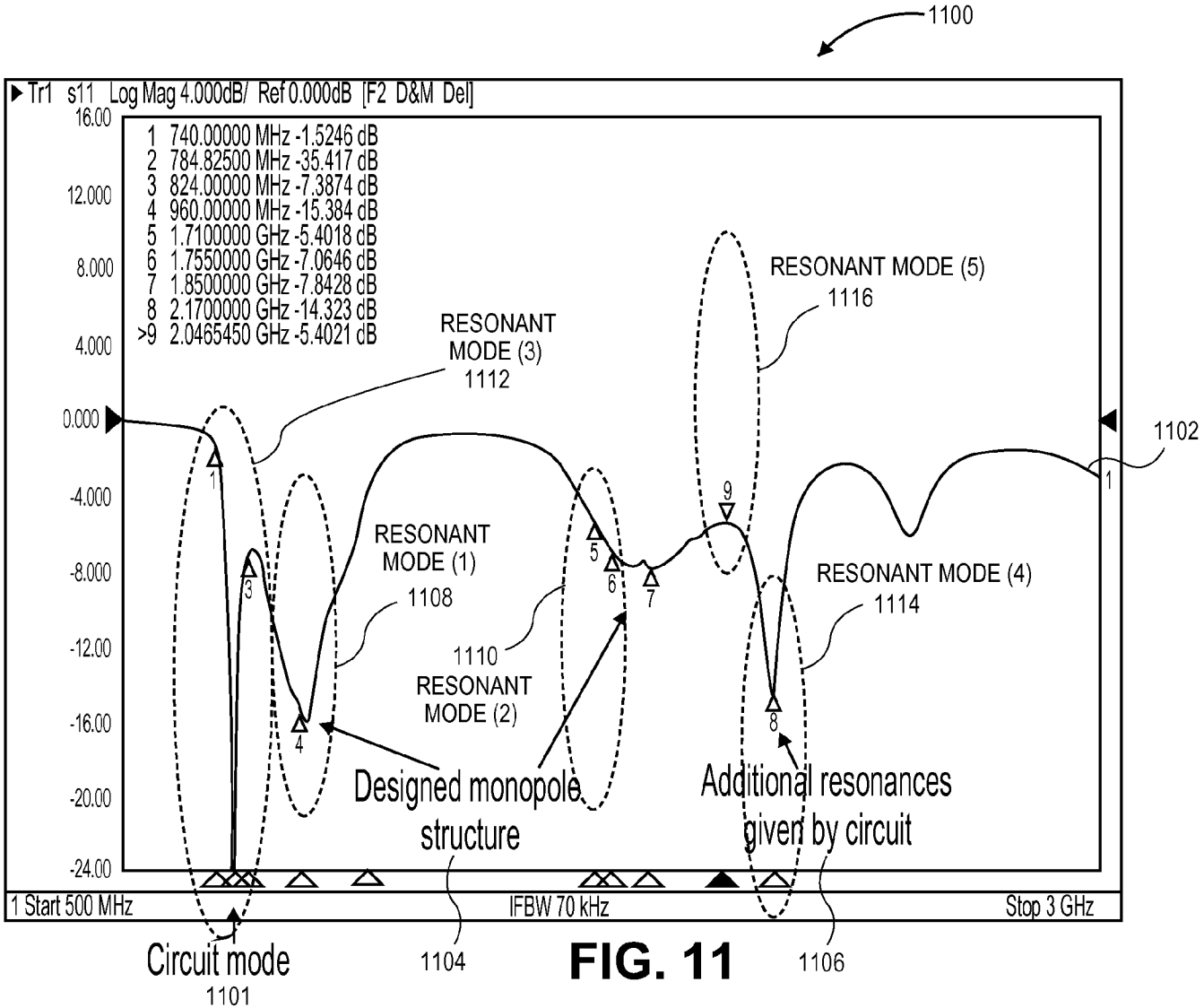
FIG. 11 is a graph of measured return loss of the multi-mode wideband antenna of FIGS. 7-10 according to one embodiment.
Figure 12:
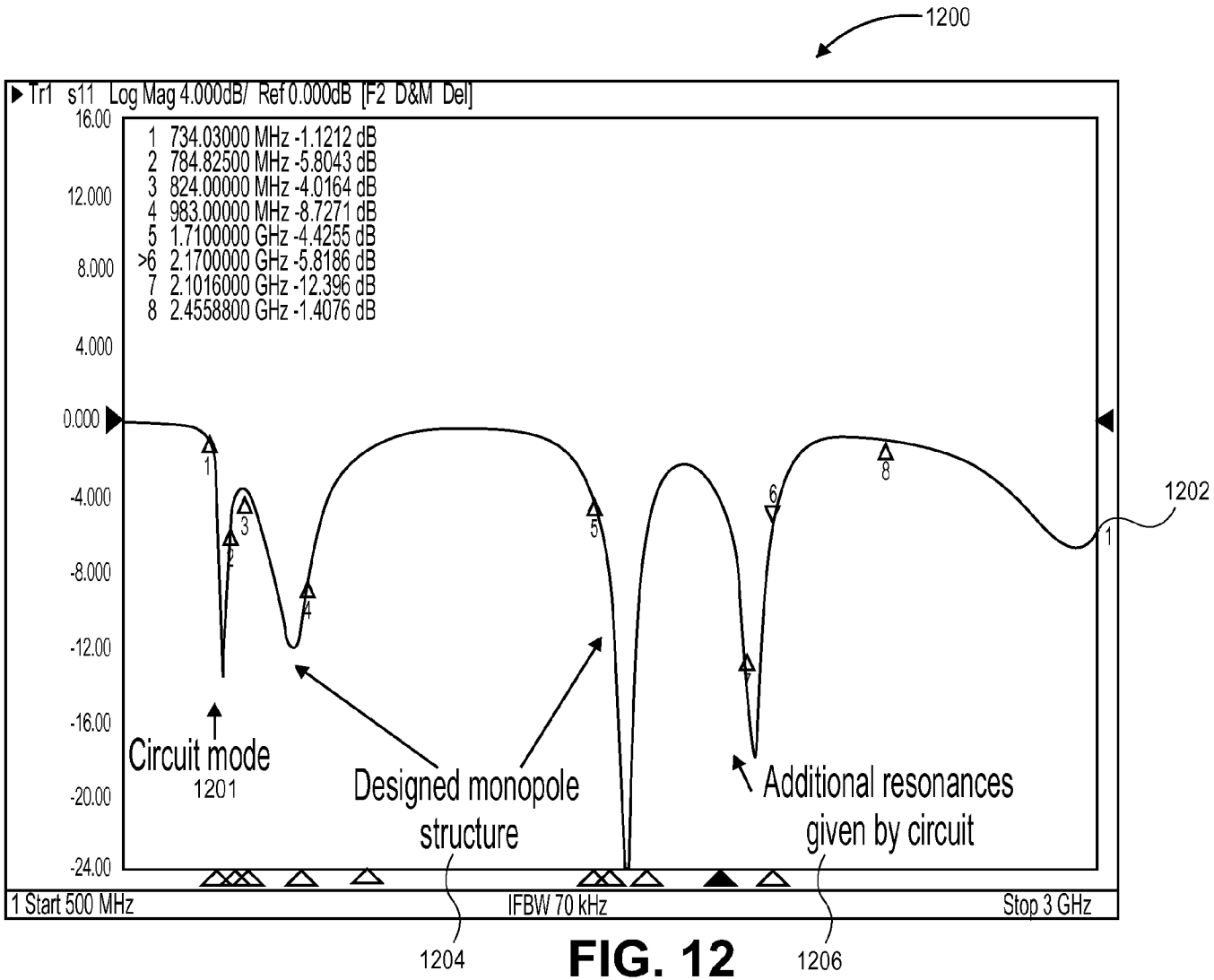
FIG. 12 is a graph of measured return loss of a multi-mode wideband antenna according to another embodiment.

In the depicted embodiment, the dual-mode monopole antenna 100 is a first monopole with folded arms. The first monopole with folded arms includes a base coupled to the single RF input 152, a first arm 112 extending out from a first side of the base, and a first folded arm 114 extending back towards the first side of the base from a distal end of the first arm 112. In this embodiment, the first arm 112 is configured to provide a first resonant mode and the first folded arm 114 is configured to provide a second resonant mode. The antenna circuit 120 may include a line structure 121 coupled to the ground plane 130, a strip 122 coupled to the line structure 122, and a second folded arm 124 extending back towards the line structure 121 from a distal end of the strip 122. In one embodiment, the strip 122 is disposed in parallel with the first arm 112 and farther away from the single RF input 142 than the first arm 112. The strip 122 is disposed to form a gap between a portion of the first arm 112 and a portion of the strip 122. In one embodiment, the strip 122 is configured to operate as at least a portion of a capacitor of the antenna circuit 120, and the line structure 121 is configured to operate as at least a portion of an inductor of the antenna circuit 120 in the circuit mode. The circuit mode concept is that the energy is fed from another antenna and there are coupling strips that operate as at least a portion of a capacitor (C) and a line structure (usually a meandered line) that operates as at least a portion of an inductor (L). The formed series LC resonances are called herein as a circuit mode, such as illustrated in FIGS. 11-12. In one embodiment, the line structure 121 is an inductive shorting strip coupled between the strip 122 and the ground plane 130. In this configuration, the first arm 112 operates as a coupling feed to capacitively excite the strip 122 through the gap between the portions of the first arm 112 and the strip 122. The inductive shorting strip provides additional inductance to further improve the impedance matching and to achieve a dual-resonant mode to cover a desired frequency range. The radiation strip 122 and the line structure 121 also contribute their high-order modes in the high band to cover the desired frequency range. Thus, the strip 122 and line structure 121 are configured to provide additional LC resonances to the resonant modes of the dual-mode monopole antenna 110.

In one embodiment, the multi-mode wideband antenna 100 has an approximate height (H) and a width (W) for 2D structures. In one embodiment, an overall height of the multi-mode wideband antenna is 19 mm, and an overall width of the multi-mode wideband antenna 100 is 58 mm. In another embodiment, the dual-mode monopole antenna 110 and the antenna circuit 120 are disposed within a 2D area having a width of 58 mm and a height of 19 mm above the ground plane 130. Alternatively, other dimensions can be used as would be appreciated by one of ordinary skill in the art having the benefit of this disclosure. Also, the multi-mode wideband antenna 100 may have an approximate height (H), width (W), and depth (D). For example, in one embodiment, a dual-mode monopole antenna and an antenna circuit are disposed within a 3D volume having a width of 58 mm, a height of 18 mm, and a depth of 5 mm. In another embodiment, a dual-mode monopole antenna and an antenna circuit are disposed within a 3D volume having a width of 58 mm, a height of 7 mm, and a depth of 5 mm. Alternatively, other dimensions can be used as would be appreciated by one of ordinary skill in the art having the benefit of this disclosure. In another embodiment, the ground plane 130 has the same overall width as the width of the multi-mode wideband antenna 100. Alternatively, the ground plane 130 may be less than or greater in width than the multi-mode wideband antenna 100.

In the depicted embodiment, there are four resonate modes created by the dual-mode monopole antenna 110 and the antenna circuit 120. In one embodiment, the first arm 112 provides the first resonant mode, and the first folded arm provides the second resonant mode, as described above. The strip 122 is configured to provide a third resonant mode, and the second folded arm is configured to provide a fourth resonant mode. In one embodiment, the first resonant mode is in a range between 680 MHz and 1240 MHz, the second resonant mode is in a range between 1.6 GHz and 2.0 GHz, the third resonant mode is in a range between 715 MHz and 845 MHz, and the fourth resonant mode is in a range between 1.91 GHz and 2.43 GHz. In another embodiment, the first resonant mode is in a range between 700 MHz and 1000 MHz, the second resonant mode is in a range between 1660 MHz and 2060 MHz, the third resonant mode is in a range between 550 MHz and 850 MHz, and the fourth resonant mode is in a range between 1910 MHz and 2310 MHz. Alternatively, other combination of resonant modes may be achieved as would be appreciated by one of ordinary skill in the art having the benefit of this disclosure. In another embodiment, an order of frequencies of the four resonant modes from lowest to highest frequency is the third resonant mode, the first resonant mode, the second resonant mode, and the fourth resonant mode. It should also be noted that the first, second, third and fourth notations on the resonant modes are not be strictly interpreted to being assigned to a particular frequency, frequency range, or elements of the multi-mode wideband antenna. Rather, the first, second, third, and fourth notations are used for ease of description. Alternatively, other orders may be achieved as would be appreciated by one of ordinary skill in the art having the benefit of this disclosure.

In another embodiment, the dual-mode monopole antenna 110 and the antenna circuit 120 can be configured to create three resonant modes or more than four resonant modes. In one embodiment, five resonant modes are archived. The first resonant mode is in an range between 680 MHz and 1240 MHz, the second resonant mode is in a range between 1.6 GHz and 2.0 GHz, the third resonant mode is in a range between 715 MHz and 845 MHz, the fourth resonant mode is in a range between 1.81 GHz and 2.13 GHz, and the fifth resonant mode is in a range between 1.91 GHz and 2.43 GHz. In one embodiment, the second and fifth resonant modes can be synthesized and combined together as would be appreciated by one of ordinary skill in the art having the benefit of this disclosure. In another embodiment, it could be said that the first resonant mode has an approximate 280 MHz bandwidth centered at approximately 960 MHz, the second resonant mode has an approximate 200 MHz bandwidth centered at approximately 1.8 GHz, the third resonant mode has an approximate 65 MHz bandwidth centered at approximately 780 GHz, the fourth resonant mode has an approximate 260 MHz bandwidth centered at approximately 2.7 GHz, and the fifth resonant mode has an approximate 160 MHz bandwidth centered at approximately 1.97 GHz. In one embodiment, the dual-mode wideband antenna 100 can be designed to operate in the following target bands: 1) Verizon LTE band: 746 to 787 MHz; 2) US 850 (band 5): 824 to 894 MHz; 3) GSM900 (band 8): 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. These resonance bandwidths may be characterized by VNA measurements with about −5 dB bandwidth (BW). Alternatively, the dual-mode wideband antenna 100 can be designed to operate in different combinations of frequency bands as would be appreciated by one of ordinary skill in the art having the benefit of this disclosure.

Figure 2:
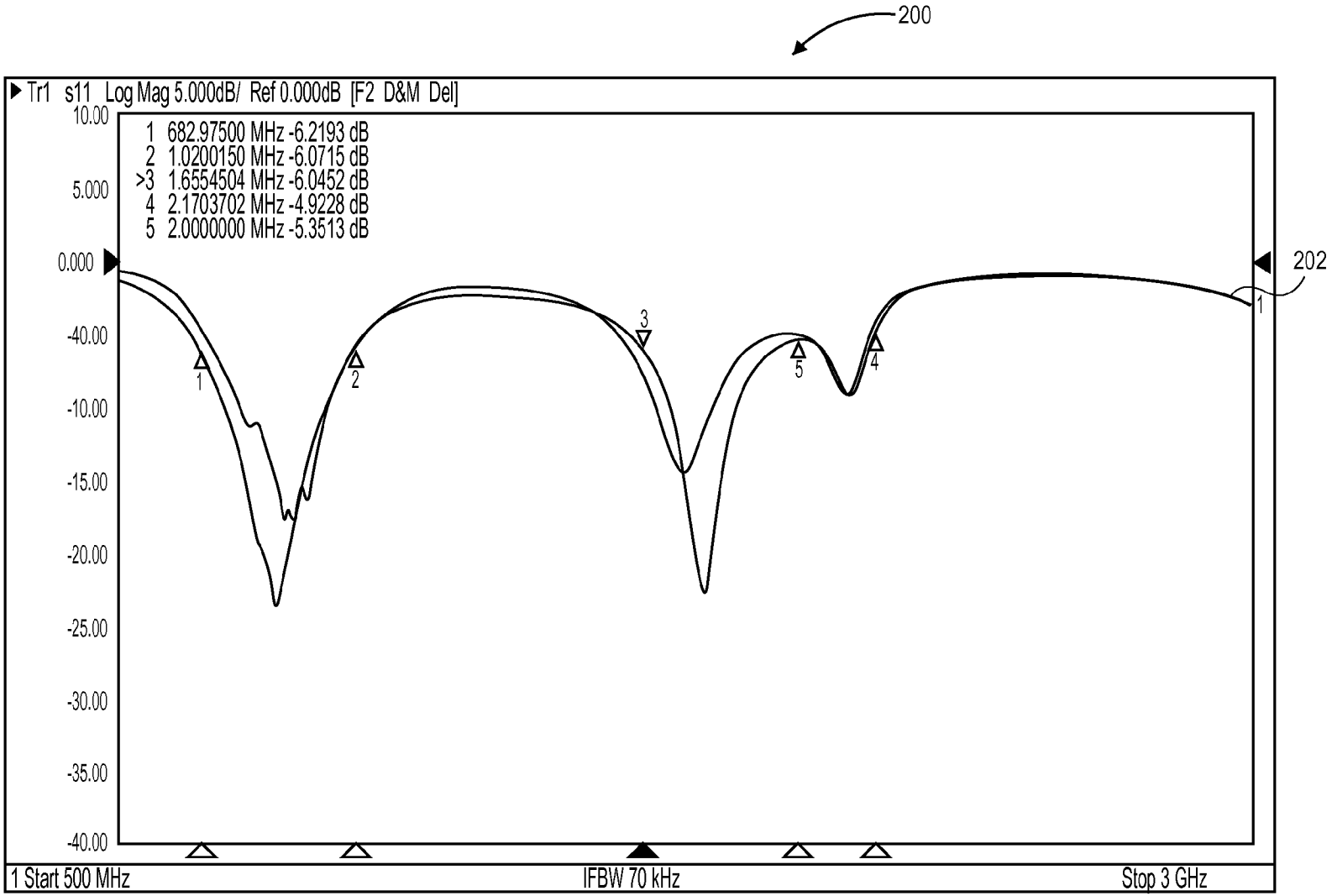
FIG. 2 is a graph of measured return loss of the multi-mode wideband antenna of FIG. 1 according to one embodiment.

FIG. 2 is a graph 200 of measured return loss 202 of the multi-mode wideband antenna 100 of FIG. 1 according to one embodiment. The graph 200 shows the measured return loss (|S11|) of the structure of the multi-mode wideband antenna 100 of FIG. 1. The 6 dB bandwidth covers from approximately 682 MHz to 1020 MHz, and 5 dB bandwidth covers 1655 MHz to 2.17 GHz. As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. For example, the target band can be Verizon LTE band and the GSM850/900 band, and the multi-mode wideband antenna 100 can be tuned to optimize the efficiency for this band as well as for other bands, such as DCS, PCS, and WCDMA bands. The efficiency of the multi-mode wideband antenna may be done by adjusting dimensions of the 2D structure, the gaps between the elements of the structure, or a combination of both. Similarly, 3D structures can be modified in dimensions and gaps between elements to improve the efficiency in certain frequency bands as would be appreciated by one of ordinary skill in the art having the benefit of this disclosure. It should also be noted that the antennas described herein may be implemented with two-dimensional geometries, as well as three-dimensional geometries as described herein.

Conventional WAN antennas may provide 704 to 983 MHz for LTE bands, GSM 850/900 bands and 1.710 to 2.17 GHz to cover DCS, PCS, WCDMA bands. However, as described above, these conventional WAN antennas have active switching elements to switch between these antennas in order to hop between the LTE bands and GSM 850/900 bands. These active switching elements involved complicated circuits to intelligently switch and operates at those frequency bands. For example, one conventional switchable antenna is developed by Pulse Electronics. This switchable antenna for mobile connected personal computers (PCs) enables four resonant modes for low band: 700-750 MHz (LTE low), 750-790 MHz (LTE high), 820-900 MHz (GSM850), and 880-960 MHz (GSM900), and covers multiple resonant modes for high band applications 1800/1900/2100 with a switch that is implemented directly from the device's display area. Another conventional antenna is a planar inverted F antenna (PIFA), which is a type of quarter-wave half-patch antenna. Another conventional WAN antenna may provide LTE and EVDO antennas an active switching circuit to switch between the two. These conventional designs that usually involved monopole structure (a single meandered line) (e.g., monopole or PIFA) with other parasitic structures could not provide good matching in compact spaces. However, the embodiments described herein provide better matching within the compact space associated with the user device. Also, the embodiments described herein use an excitation portion that operates as a feeding structure (e.g., teeth-feeding feeding structure) in a 3D manner.

In contrast, the embodiments described herein uses a single RF input for the same frequency bands, but can be more easily integrated into the user device. In some embodiments, the dual-mode monopole antenna provides two wide resonances at low band (e.g., 850 MHz) and high band (e.g., 1.8 GHz), and then operates as a feeding structure to the coupled antenna circuit. The antenna circuit forms a circuit mode to provide a resonance to extend the bandwidth at low band (e.g., 750 MHz) and also provides additional resonances at high band. The two sets of low and high resonances can be synthesized and combined to meet LTE and penta-band bandwidths. Alternatively, the two sets can be synthesized and combined to meet LTE and quad- or tri-band bandwidths as well.

Low profile multi-mode antennas are especially attractive to compact, conformal user devices, such as mobile devices. However, as fundamental antenna theory states the antenna bandwidth is proportional to the effective radiation volume, the antenna performance (e.g., bandwidth and efficiency), and the quality factor is degraded by the constrained space given by the user device. This is expressed in Chu's limit as follows:

$$Qualityfactor \sim \frac{1}{B.W.} \sim 1/r^3$$

In other words, the size constraint could radically change the antenna design concept and methodology. For example, the embodiments described below describe 3D structures that can improve the quality factor of the antenna design. Embodiments of the 3D structures provide a compact designed 3D structure to cope with the compact user device environment.

Figure 3:
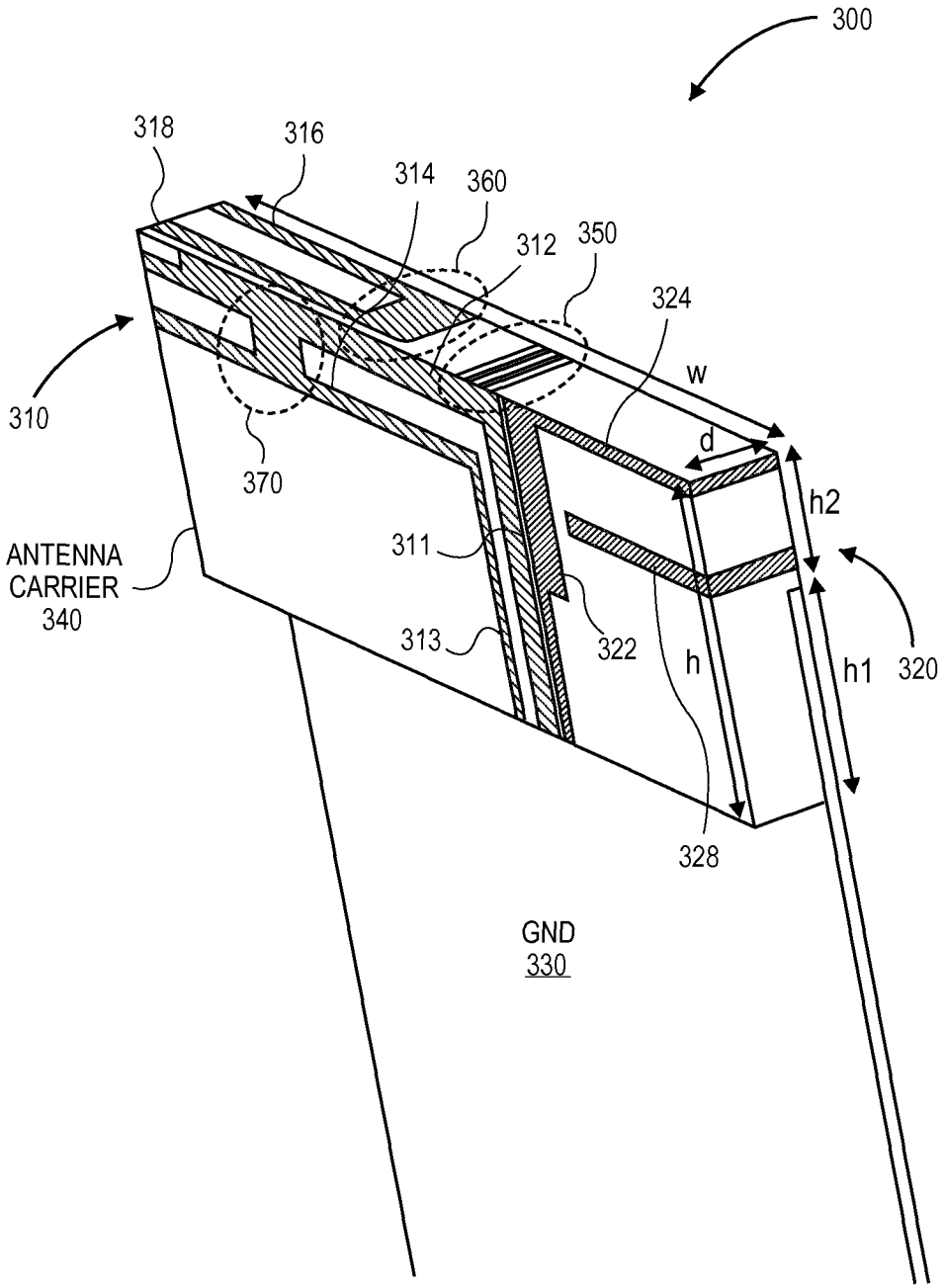
FIG. 3 illustrates a top perspective view of a multi-mode wideband antenna including a first antenna structure and a passive antenna structure according to one embodiment.
Figure 4:
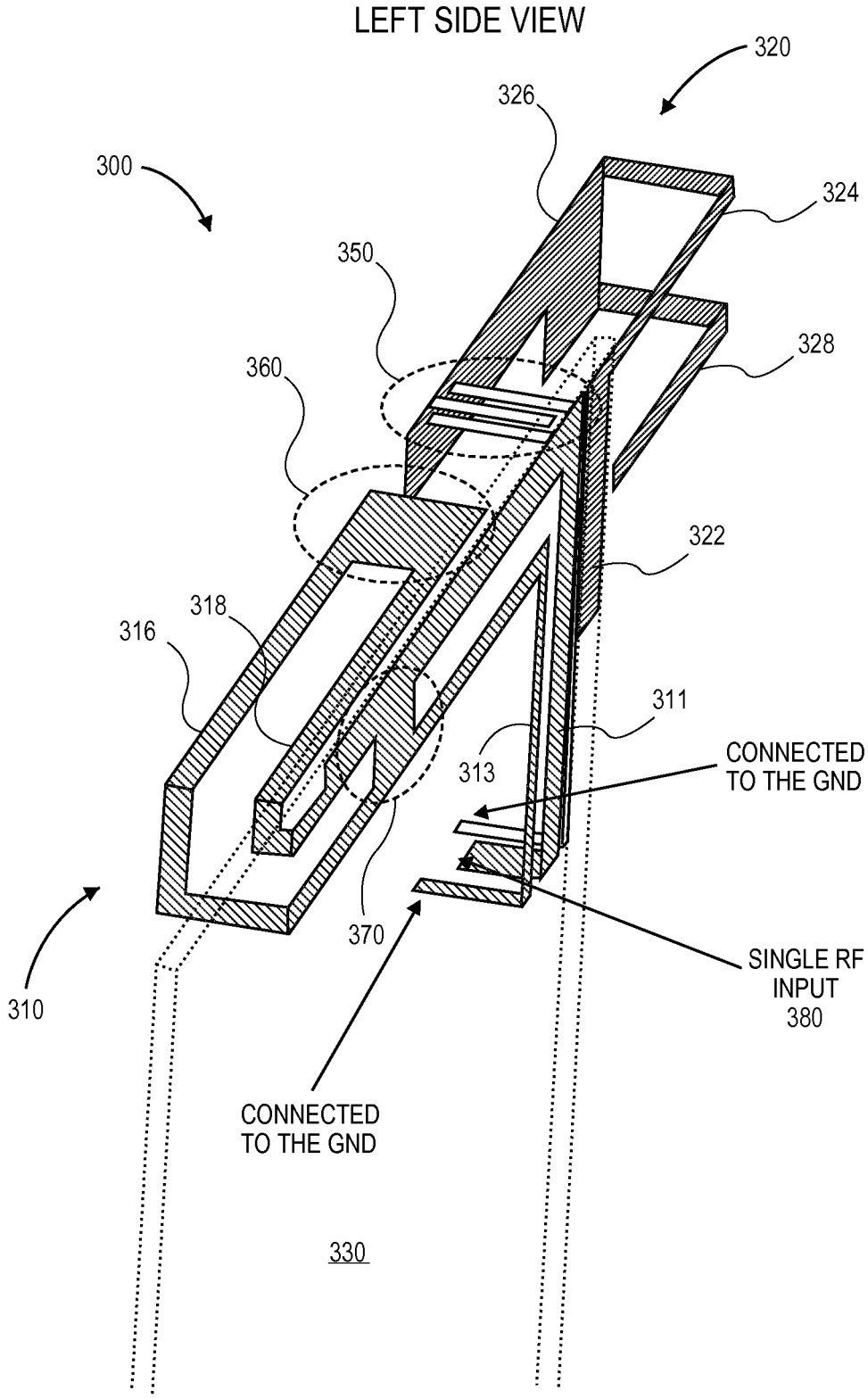
FIG. 4 illustrates a left side view of the multi-mode wideband antenna of FIG. 3.
Figure 5:
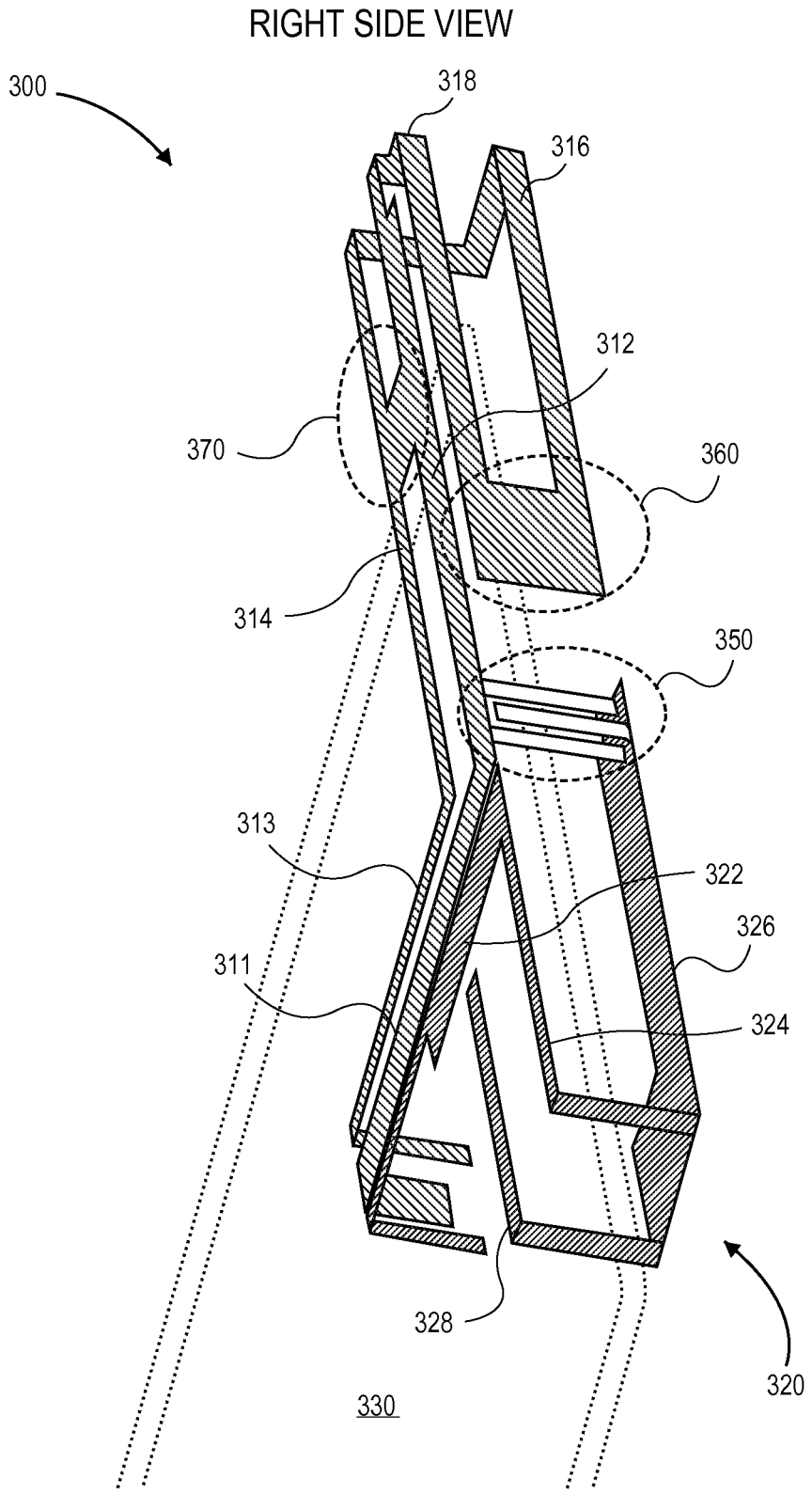
FIG. 5 illustrates a right side view of the multi-mode wideband antenna of FIG. 3.
Figure 6:
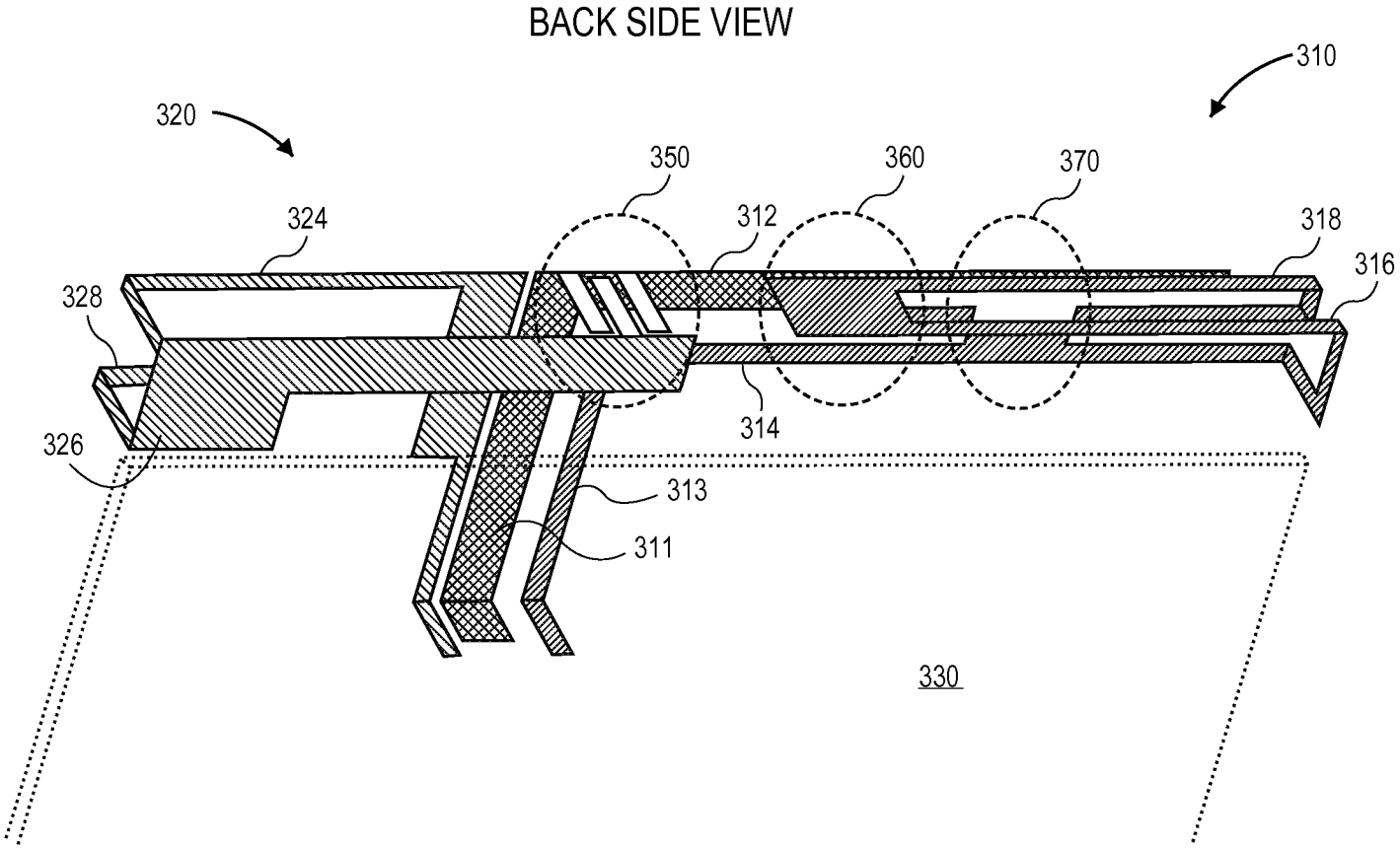
FIG. 6 illustrates a back side view of the multi-mode wideband antenna of FIG. 3.

FIGS. 3-6 illustrates different views of a multi-mode wideband antenna 300 including a first antenna structure 310 and a passive antenna structure 320 according to one embodiment. FIG. 3 illustrates a top perspective view of the multi-mode wideband antenna 300. The first antenna structure 310 and passive antenna structure 320 are 3D structures that wrap around different sides of an antenna carrier 340. In one embodiment, the antenna carrier 340 has dimensions of 18 mm in height, 58 mm in width, and 5 mm in depth. Alternatively, other dimensions may be used. In the depicted embodiment, a ground plane 330, which may be similar to the ground plane 130 of FIG. 1, is extruded underneath the antenna carrier 340 by a distance, such as 11 mm. This affects the antenna's performance in that the resulting antenna structure has a smaller volume, such as a volume of 7 mm in effective overall height, 58 mm in overall width, and 5 mm in overall depth for effective radiation.

In the depicted embodiment, the first antenna structure 310 is coupled to a single RF input and is configured to provide a first low-band resonant mode and a second high-band resonant mode. The first antenna structure operates as a feeding structure to the passive antenna structure. The passive antenna structure 320 is coupled to the ground 330 and is fed by the first antenna structure. The passive antenna structure is configured to extend a bandwidth of the multi-mode wideband antenna 300 to include a third-low-band resonant mode and one or more additional high-band resonant modes. In one embodiment, the third low-band resonant mode is less than the first low-band resonant mode. The first antenna structure 310 is configured to operate as a feeding structure to the passive antenna structure 320.

In one embodiment, the first antenna structure 310 and the passive antenna structure 320 are disposed to wrap around multiple sides of the antenna carrier 340. In one embodiment, the first antenna structure 310 is wrapped around the bottom, front, left, and top sides of the antenna carrier 340, and the passive antenna structure 320 is wrapped around the bottom, front, right, and back sides of the antenna carrier 340. Thus, the first antenna structure 310 and passive antenna structure 320 may be wrapped around all six sides of the antenna carrier 340.

In the depicted embodiment, the first antenna structure 310 includes a first monopole structure with folded arms having a first base 313 coupled to the single RF input 380. The first base 313 extends from the single RF input 380 towards a top side of the antenna carrier 340. At the top of the front side of the antenna carrier 340, the first monopole structure has a first arm 312 that extends out from a first side of the first base 313 on the front side of the antenna carrier 340 towards a first side (e.g., left side in FIG. 3) of the antenna carrier 340. The first arm 312 wraps around the first side of the antenna carrier 340 to the top side of the antenna carrier 340. A first folded arm 318, which is coupled to the first arm 312, extends back towards the first side of the first base on the top side of the antenna carrier 340.

In the depicted embodiment, the first monopole structure also includes a second base 313 coupled to the ground plane 330, the second base 313 extending from the ground plane 330 towards the top side of the antenna carrier 340. The second base 313 is disposed parallel with the first base 312 and closer to the first side of the antenna carrier 340 than the first base 311. A second arm 314 extends from a first side of the second base 313 on the front side of the antenna carrier 340 towards the first side (e.g., left side) of the antenna carrier 340, wrapping around the first side of the antenna carrier 340 to the top side of the antenna carrier 340. A second folded arm 316, which is coupled the second arm 314, extends back towards the first side of the second base 313 on the top side of the antenna carrier 340. The first folded arm 318 at the top side of the antenna carrier 340 is disposed closer to the front side of the antenna carrier 340 than the second folded arm 316. The first arm 312 is configured to provide the first low-band resonant mode and the second arm 314 is configured to provide the second high-band resonant mode. In one embodiment, the first low-band resonant mode is in a range between 680 MHz and 1.240 GHz and the second high-band resonant mode is in a range between 1.6 GHz and 2.0 GHz. In another embodiment, the first low-band resonant mode is in a range between 700 MHz and 1000 MHz and the second high-band resonant mode is in a range between 1660 MHz and 2060 MHz. Alternatively, other ranges may be achieved by various the dimensions and gaps of the first monopole structure.

In one embodiment, a first coupling portion 360 is disposed at the top side of the antenna carrier 340 to couple a distal end of the first folded arm 318 to a distal end of the second folded arm 316. In another embodiment, a second coupling portion 370 is disposed at the front side of the antenna carrier 340 to couple a portion of the first arm 312 that extends from the first side of the first base 311 to the first side of the antenna carrier and a portion of the second arm 314 that extends from the first side of the second base 313 to the first side of the antenna carrier 340.

In another embodiment, the first antenna structure includes a first monopole with folded arms coupled to the single RF input at a first end and coupled to the ground plane at a second end. In a further embodiment, the passive antenna structure 320 includes a 3D closed loop structure coupled to the ground plane at a first end. The first monopole with folded arms and the closed loop structure can include other dimensions and shapes than those illustrated in FIG. 3-6.

Strong resonances are not easily achieved within a compact space within user devices, especially with the spaces described above. The structure of the first antenna structure 310 provides two strong resonances at 950 MHz and 1.8 GHz bands by controlling the first and second coupling portions 360 and 370, respectively. Strong resonances, as used herein, refer to a significant return loss at those frequency bands, which is better for impedance matching to 50 ohm systems. It should be noted that conventional monopole antennas may be connected at the tip, such as the first coupling portion 360, but do not have a coupling portion, such as the second coupling portion 370, and the conventional monopole antenna usually possesses a single strong resonance. However, using the second coupling portion 370, the first antenna structure 310 possesses two strong resonances.

In the depicted embodiment, the passive antenna structure 320 includes a first base 322 coupled to the ground plane 330 at the edge of the bottom side of the antenna carrier 340, and extends from the ground plane 330 towards a top side of the antenna carrier 340. In particular, the first base 322 extends from the bottom side up to the top of the antenna carrier 340. In the depicted embodiment, the first base 322 has two different widths, a first width towards the bottom of the antenna carrier 340 and a second width towards the top of the antenna carrier 340. The passive antenna structure 320 also includes a first arm 324 extending out from a first side of the first base 322 on a front side of the antenna carrier 340 towards a second side (e.g., right side in FIG. 3) of the antenna carrier 340, and wrapping around the second side of the antenna carrier 340 to a back side of the antenna carrier 340. A first folded arm 326 (illustrated in FIGS. 4-6) extending back towards the first side of the first base 322 on the back side of the antenna carrier 340.

In another embodiment, the passive antenna structure 320 includes a second arm 328 that wraps around the second side (e.g., right side) of the antenna carrier 340 from a portion of first folded arm 326, disposed on the back side of the antenna carrier 340, extends towards the front side of the antenna carrier 340, and extends back towards the first side of the first base 322 on the front side of the antenna carrier 340. This second arm 328 may be considered to be a stick-out strip that adds an additional resonance. Alternatively, additional structures may be added to achieve additional resonances. Similarly, dimensions of the existing structures may be modified to change the resonances or add additional resonances as would be appreciated by one of ordinary skill in the art having the benefit of this disclosure.

In one embodiment, the first base 322, first arm 324, and first folded arm 326 are configured to provide the third low-band resonant mode and a fourth high-band resonant mode of the one or more additional high-band resonant modes. These resonant modes are additional resonant modes provided in the circuit mode. In one embodiment, the first low-band resonant mode is in a range between 680 MHz and 1240 MHz, the second high-band resonant mode is in a range between 1.6 GHz and 2.0 GHz, the third low-band resonant mode is in a range between 715 MHz and 845 MHz, and the fourth high-band resonant mode is in a range between 1.91 GHz and 2.43 GHz. In another embodiment, the first resonant mode is in a range between 700 MHz and 1000 MHz, the second resonant mode is in a range between 1660 MHz and 2060 MHz, the third resonant mode is in a range between 550 MHz and 850 MHz, and the fourth resonant mode is in a range between 1910 MHz and 2310 MHz. Alternatively, other frequency ranges may be achieved as would be appreciated by one of ordinary skill in the art having the benefit of this disclosure.

In another embodiment, the first base 322, first arm 324, and first folded arm 326 are configured to provide the third low-band resonant mode and a fourth high-band resonant mode, and the second arm 328 is configured to provide a fifth high-band resonant mode of the one or more additional high-band resonant modes. In one embodiment, the first low-band resonant mode is in a range between 680 MHz and 1240 MHz, the second high-band resonant mode is in a range between 1.6 GHz and 2.0 GHz, the third low-band resonant mode is in a range between 715 MHz and 845 MHz, the fourth high-band resonant mode is in a range between 1.91 GHz and 2.43 GHz, and the fifth high-band resonant mode is in a range between 1.81 GHz and 2.13 GHz. Alternatively, other frequency ranges may be achieved as would be appreciated by one of ordinary skill in the art having the benefit of this disclosure.

In another embodiment, the passive antenna structure 320 includes a first element to form a capacitor (C) between the passive antenna structure 320 and the first antenna structure 310 and a second element to form an inductor (L) between the passive antenna structure 320 and the first antenna structure 310. The passive antenna structure 320 is configured to form series inductance capacitance (LC) resonances in a circuit mode. In the circuit mode, the energy is fed from the first antenna structure 310 to the passive antenna structure 320. The passive antenna structure 320 includes a strip as the first element, the strip disposed with a small gap between the first antenna structure 310. This strip operates as the capacitor and is used to couple the passive antenna structure 320 and the first antenna structure 310 and to radiate electromagnetic energy. The passive antenna structure 320 also includes a line structure (usually meandered) as the second element. The line structure operates as the inductor. The formed series LC resonances form the circuit mode resonances as described herein.

In the depicted embodiment, the multi-mode wideband antenna 300 includes an excitation portion 350. The excitation portion 350 is used to electrically couple the first antenna structure 310 and the passive antenna structure 320. It should be noted that the first antenna structure 310 and the passive antenna structure 320 are not conductively connected. In one embodiment, the excitation portion 350, as depicted in FIGS. 3-6, includes interdigitated elements. For example, in the depicted embodiment, the first antenna structure 310 includes two line structures, coupled to the first arm 312, that extend across the top side of the antenna carrier 340 towards the back side of the antenna structure 340. The passive antenna structure 320 includes a single line structure, coupled to the first folded arm 326, which extends across the top side of the antenna carrier towards the front side of the antenna structure 340. The single line structure is disposed between gaps of two similar line structures that are coupled to the first arm 312 of the first antenna structure 310. The interdigitated elements create gaps between the respective elements and between the first folded arm 326 and the first arm 312. The excitation portion 350 is configured to excite the additional resonances of the passive antenna structure 320. In one embodiment, the interdigitated elements are arranged as a teeth structure that is used to produce strong coupling in a compact form. Of course, by modifying the number of the teeth or by modifying the gaps between the teeth, the coupling or the impedance matching could be adjusted easily.

Alternatively, other configurations may be used to add additional resonant modes and to control impedance matching between the multi-mode wideband antenna and the single RF input as would be appreciated by one of ordinary skill in the art having the benefit of this disclosure.

In one embodiment, the multi-mode wideband antenna 300 includes at least three resonant modes. In another embodiment, the multi-mode wideband antenna 300 includes four resonant modes. Alternatively, the multi-mode wideband antenna may include more than four resonant modes as would be appreciated by one of ordinary skill in the art having the benefit of this disclosure.

It should be noted that the embodiments described herein may be used for a main antenna of the user device, as well as for diversity antennas or Multi-Input and Multi-Output (MIMO) antennas.

FIGS. 7-10 illustrate various views of an exemplary multi-mode wideband antenna 700 according to another embodiment. FIGS. 7-10 describe and illustrate specific dimensions of the multi-mode wideband antenna 700. Of course, the design can be varied in width, lengths, turning angles, and other dimensions to achieve different target multi-mode bands as would be appreciated by one of ordinary skill in the art having the benefit of this disclosure. Also, it should be noted that for larger or smaller devices the dimensions may need to be scaled accordingly.

Figure 7:
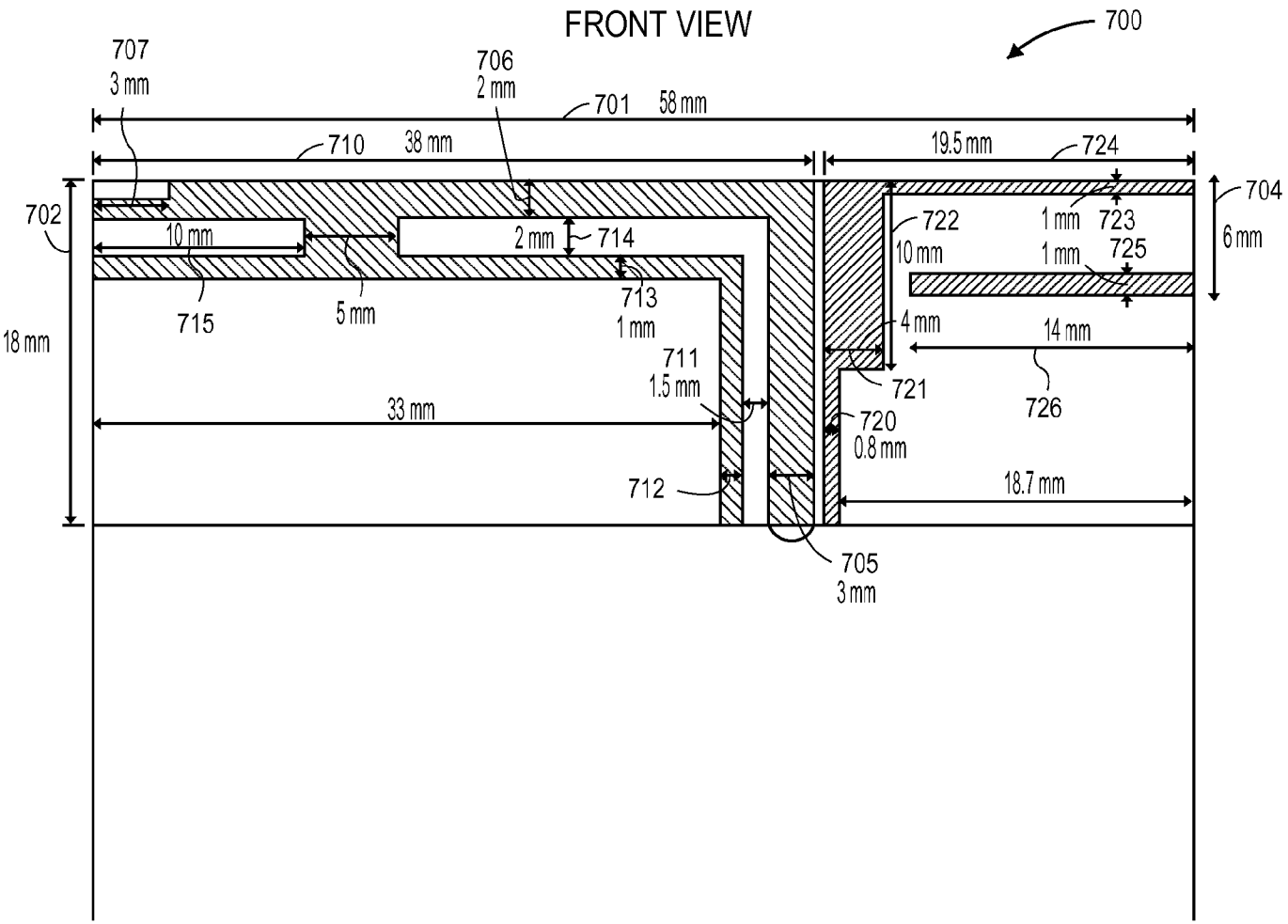
FIG. 7 illustrates a front view of an exemplary multi-mode wideband antenna according to another embodiment.

FIG. 7 illustrates a front view of an exemplary multi-mode wideband antenna 700. In this depicted embodiment, the overall width 701 of the antenna 700 is 58 mm, the overall height 702 is 18 mm, and the overall depth 703 is 5 mm (illustrated in FIGS. 8-9).

Figure 8:
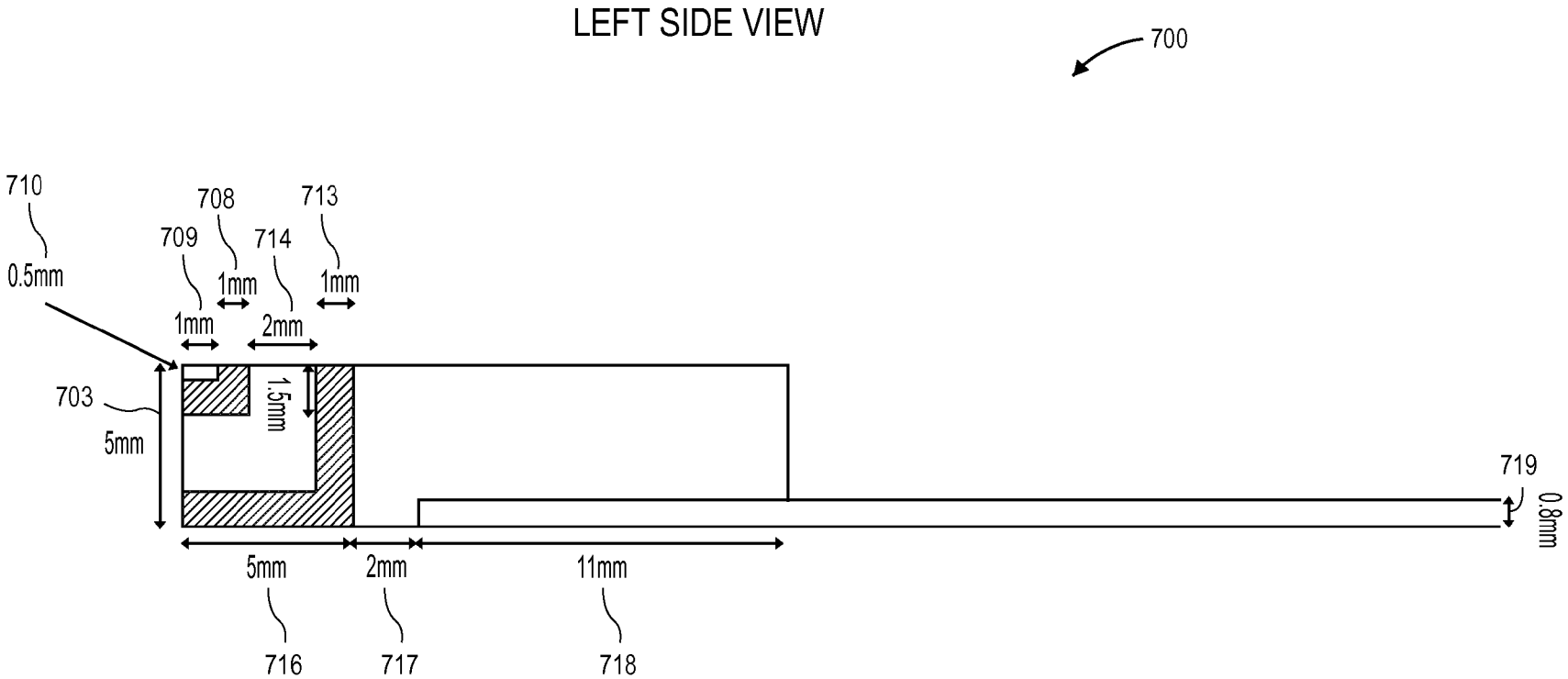
FIG. 8 illustrates a left side view of the multi-mode wideband antenna of FIG. 7.
Figure 10:
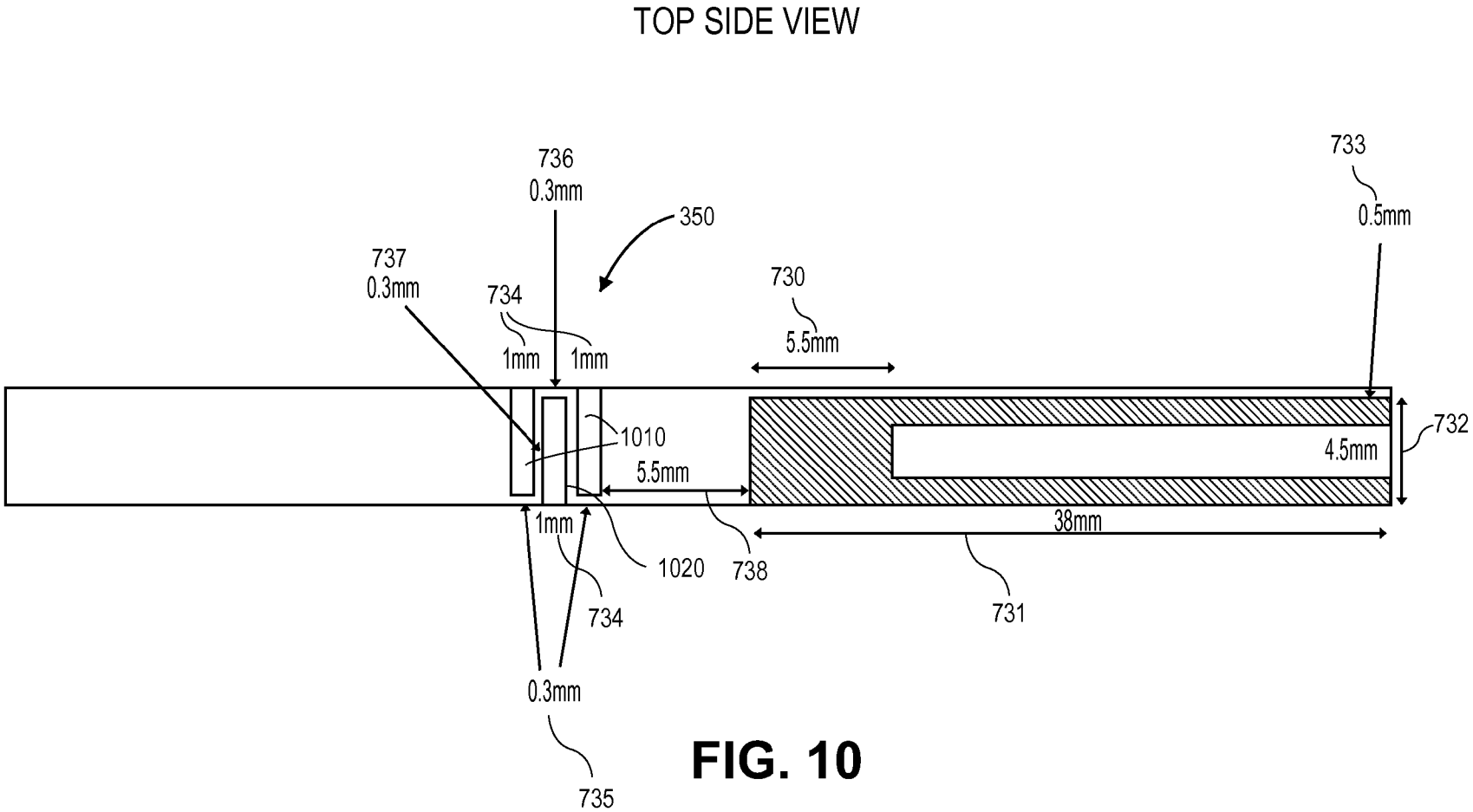
FIG. 10 illustrates a top side view of the multi-mode wideband antenna of FIG. 7.

The first antenna structure (e.g., 310) has the following dimensions as illustrated in FIGS. 7, 8, and 10. A first base of the first antenna structure has a width 705 that is 3 mm and extends from the bottom of the antenna carrier to the top of the antenna carrier. A first arm has a length 710 of 38 mm that extends from the base to the left side (illustrated in FIG. 8), and has a first width 706 of 2 mm and a second width 708 of 1 mm that extends a length 707 of 3 mm from the left side of the antenna carrier. This leaves a gap that is 3 mm in length, 1 mm in height 709, and 0.5 mm in depth 710 at the top left corner of the front side of the antenna carrier. The first arm wraps around the left side having the width 708 of 1 mm and extending to a top surface of the antenna carrier (illustrated in FIG. 10) in a first L shape. The bottom depth of the first L-shape is 1.5 mm in depth from the front side, and 2 mm in height up to the top side. At the top surface, the first arm is coupled to a first folded arm that extends back towards the first base on the top side of the antenna carrier. The first folded arm has a length 731 of 38 mm and a width 708 of 1 mm. The first folded arm couples to a second folded arm at a first coupling portion (e.g., 360). The first coupling portion has a depth 732 of 4.5 mm and a width (or length) 730 of 5.5 mm from the end of the first and second folded arms. The first coupling portion can be disposed at a distance 738 of 5.5 mm from an excitation portion 350 on the top side of the antenna carrier. The first folded arm is disposed at 0.5 mm depth 733 on the top side of the antenna carrier.

The second folded arm on the top side is coupled to a second arm that wraps around the left side (illustrated in FIG. 8) in a second L-shape that is larger than the first L-shape. The second L-shape has a height 716 of 5 mm, a depth 703 of 5 mm, and a width 713 of 1 mm. The second L-shape has a gap 714 of 2 mm between the first L-shape. The second L-shape couples to the second arm on the front side of the antenna carrier. The second arm also had a width 713 of 1 mm, and a length of 34 mm. The second arm is disposed to have a gap 714 of 2 mm between the first arm and second arm. A second coupling portion couples the first arm and the second arm. The second coupling portion may be 5 mm in width and 2 mm in height (same as gap 714), and may be disposed 100 mm in distance 715 from the left side of the antenna carrier. The second arm is coupled to a second base that has a width 712 of 1 mm, and is disposed at a distance of 33 mm from the left side of the antenna carrier. The first and second bases can be disposed to have a gap 711 of 1.5 mm.

As illustrated in FIG. 8, the ground plane extrudes underneath the antenna carrier by a height 718 of 11 mm, leaving a gap 717 of 2 mm between the second L-shape on the left side. The ground plane has a depth 719 of 0.8 mm. By extruding the ground plane underneath the antenna carrier by a distance, the antenna's performance can be enhanced since the resulting antenna structure primarily has volume of 7 mm in effective overall height (e.g., height 716 and gap 717 from the top side to the top of the ground plane), 58 mm in overall width, and 5 mm in overall depth for effective radiation.

Figure 9:
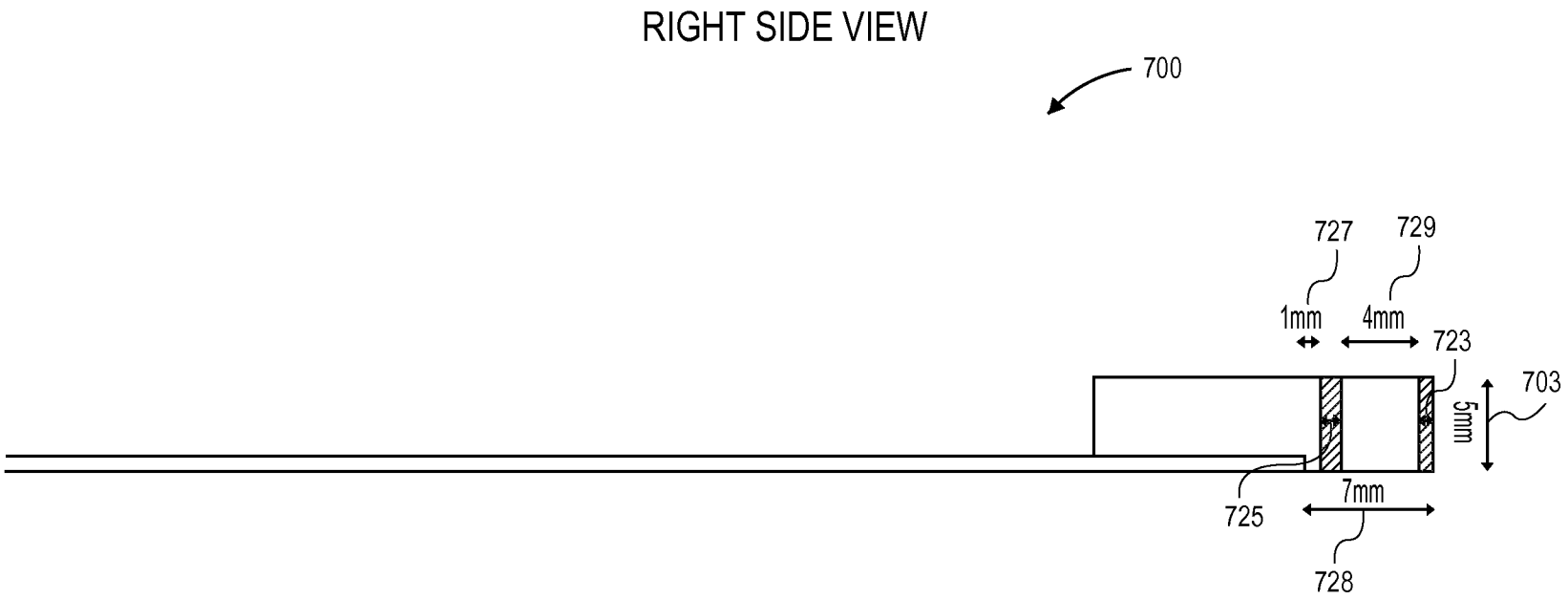
FIG. 9 illustrates a right side view of the multi-mode wideband antenna of FIG. 7.

The passive antenna structure (e.g., 320) has the following dimensions as illustrated in FIGS. 7 and 9. A first width 720 of a first portion of a base is 0.8 mm and a second width 721 of a second portion of the base is 4 mm and a height 722 of the second portion of the base is 10 mm. A first arm (e.g., 324) has a length 724 of 19.5 mm to the side of the antenna carrier, and a width 723 of 1 mm. A second arm (e.g., 328) has a width 725 of 1 mm and a length 726 of 14 mm. A distance 704 between a top of the first arm and a bottom of the second arm is 6 mm. The first arm wraps around a right side of the antenna carrier (illustrated in FIG. 9). On the right side, the first arm has a depth 703 of 5 mm and a width 723 of 1 mm. The second arm also wraps around the right side, and the second arm has a depth 703 of 5 mm and a width 725 of 1 mm. There is a gap 727 of 1 mm between the second arm and the ground plane. As described with respect to FIG. 8, an overall effective height 728 of 7 mm is between a top of the antenna carrier and the ground plane that extrudes beneath the antenna carrier by 11 mm. There is also a gap 729 of 4 mm between the first and second arms. A first folded arm (e.g., 326 illustrated in FIGS. 4-6) extending back towards the first side of the first base on the back side of the antenna carrier (not illustrated with dimensions). In one embodiment, the first folded arm on the back side has a L-shape, with a first portion has a first height of 6 mm that extends from the bottom of the second arm to the top of the first arm) and a has a width of 2 mm. A second portion extends from the first portion past the base to the excitation portion 350 with a total length of 15 mm from the right side. The second portion has a second height of 3 mm.

As illustrated in the top side view of FIG. 10, the excitation portion 350 has a first tooth 1020 that extends from the first folded arm of the passive antenna structure that is disposed on the back side of the antenna carrier. The first tooth is 1 mm in width 734 and extends to have a gap 736 of 0.3 mm between the tooth and the first arm of the first antenna structure that is disposed on the front side of the antenna carrier. The excitation portion 350 also has two teeth 1010 that each has a width 734 of 1 mm and extends from the first arm of the first antenna structure to have a gap 735 of 0.3 mm between the first folded arm on the back side of the antenna carrier. The two teeth 1010 have a gap 737 of 0.3 mm on both side of the tooth 1020. Also, as described above, the excitation portion 350 is disposed at the distance 738 of 5.5 mm from the first coupling portion on the top side.

FIG. 11 is a graph 1100 of measured return loss 1102 of the multi-mode wideband antenna 700 of FIGS. 7-10 according to one embodiment. The graph 1100 shows the measured return loss 1102 of the structure of the multi-mode wideband antenna 700. The multi-mode wideband antenna 700 includes five resonant modes. The designed monopole structure 1104 provides a first resonant mode 1108, centered at approximately 960 MHz, and a second resonant mode 1110, centered at approximately 1.8 GHz. The circuit mode 1101 provides a third resonant mode 1112, centered at approximately 760 MHz, and provides additional resonances given the circuit mode 1106, including a fourth resonant mode 1114, centered at centered at approximately 2.17 GHz, and a fifth resonant mode 1116, centered at approximately 1.97 GHz.

FIG. 12 is a graph 1200 of measured return loss 1202 of a multi-mode wideband antenna according to another embodiment. The graph 1200 shows the measured return loss 1202 that includes multiple resonant modes. The designed monopole structure 1204 provides first and second resonant modes, such as in FIG. 11. The circuit mode 1201 extends the bandwidth to include a third resonant mode in a range between 715 MHz and 845 MHz. The circuit mode 1201 also provides additional resonances in the high band 1206. For example, a fourth resonant mode can be in a range between 1.91 GHz and 2.43 GHz. In a further embodiment, more than four resonant modes may be achieved as described herein.

Figure 13:
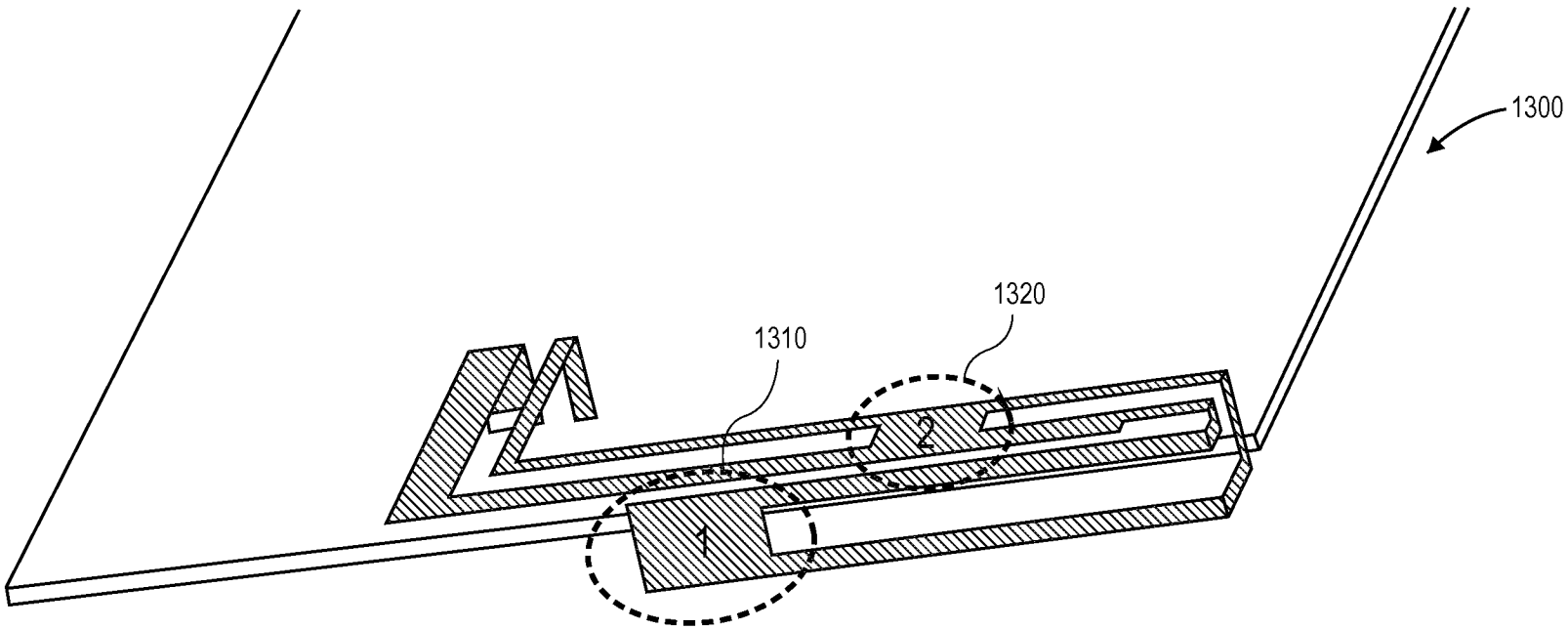
FIG. 13 illustrates one embodiment of a monopole with folded arms having two coupling portions.

FIG. 13 illustrates one embodiment of a monopole with folded arms 1300 having two coupling portions 1310, 1320. The first coupling portion 1310 is disposed at the top side of the antenna carrier and is used to couple different portions of the monopole structure. The second coupling portion 1320 is disposed at the front side of the antenna carrier and is used to couple other portions of the monopole structure. The first and second couplings 1310, 1320 create strong resonances within the compact space of the user device. The structure of the monopole with folded arms 1300 with the two coupling portions provides two strong resonances centered at 950 MHz and 1.8 GHz, such as illustrated and described in FIG. 3-6. However, in other embodiments, the first coupling portion 1310 can be positioned further away from the feed (e.g., single RF input) to shift down the corresponding resonance centered at 960 MHz to another lower frequency. For example, if the first coupling portion 1310 is moved 2 mm further away from the feed, the resonant frequency may shift down by 20 MHz. Alternatively, the first coupling portion 1310 can be positioned to shift the center frequency of the resonant mode to other frequencies.

In other embodiments, the second coupling portion 1320 can be positioned further away from the feed (e.g., single RF input) to shift down the corresponding resonance centered at 960 MHz to another lower frequency. For example, if the second coupling portion 1320 is moved 2 mm further away from the feed, the resonant frequency may shift down by 40 MHz. Alternatively, the second coupling portion 1320 can be positioned to shift the center frequency of the resonant mode to other frequencies.

Figure 14:
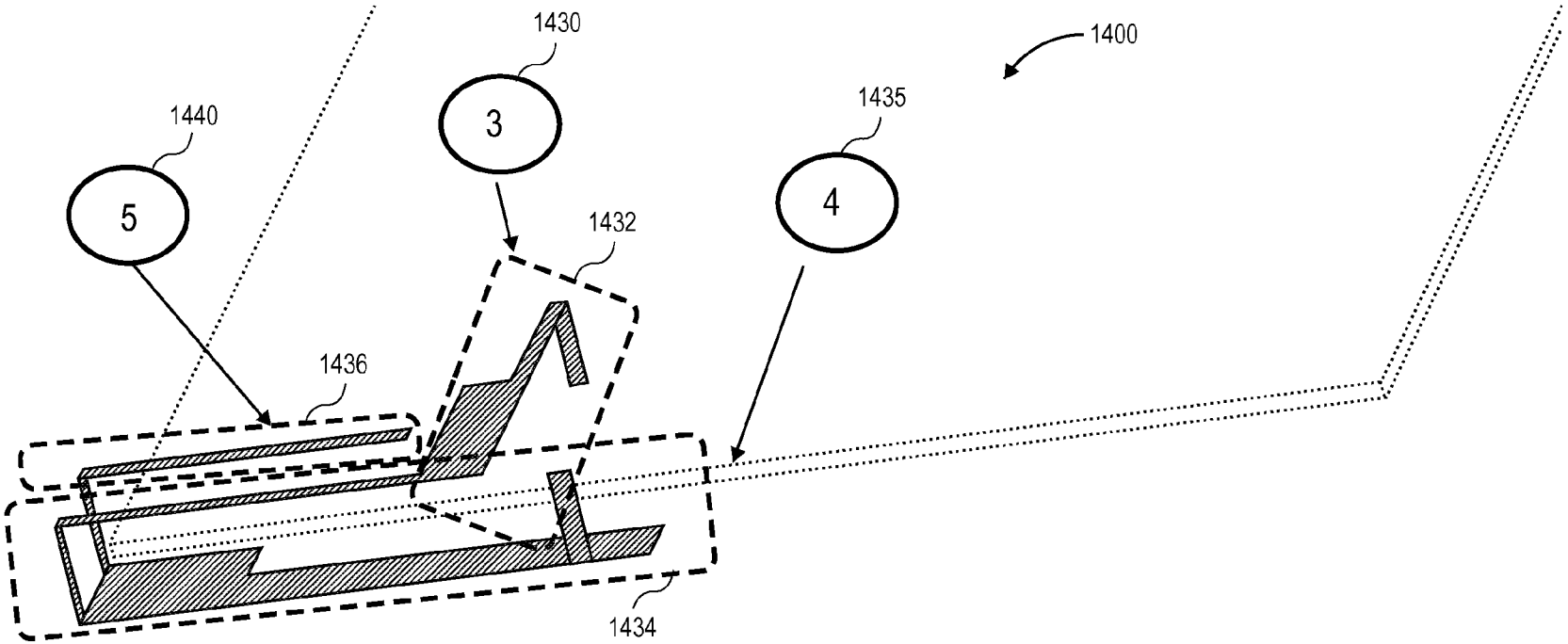
FIG. 14 illustrates one embodiment of a three-dimensional (3D) closed loop structure for a passive antenna structure.

FIG. 14 illustrates one embodiment of a three-dimensional (3D) closed loop structure 1400 for a passive antenna structure. The closed loop structure 1400 includes a first portion 1432 to provides a third resonant mode 1430, for example, centered at 760 MHz, and a second portion 1434 that provides a fourth resonant mode 1435, for example, centered at 2.17 GHz. In a further embodiment, the closed loop structure 1400 also includes a stick-out strip 1436 to provide a fifth resonant mode 1440, for example, centered at 1.97 GHz. In other embodiments, the stick-out strip 1436 can be widened or lengthened to improve the return loss of fifth resonant mode centered at 1.97 GHz. For example, if the stick-out strip 1436 were 1 mm wider, the resonance centered around 1.97 GHz could be better matched for impedance matching (e.g., 0.75 dB return loss improvement).

In another embodiment, the size of the ground plane can affect the antenna performance, especially in the lower bands. If the ground plane is extended in height, the resonances in the lower band, for example, between 760 and 1050 MHz may be improved. For example, a 20 mm extension of the ground plane may give 4-5 dB deeper return loss within the lower bands (e.g., 760 to 1050 MHz).

Figure 15:
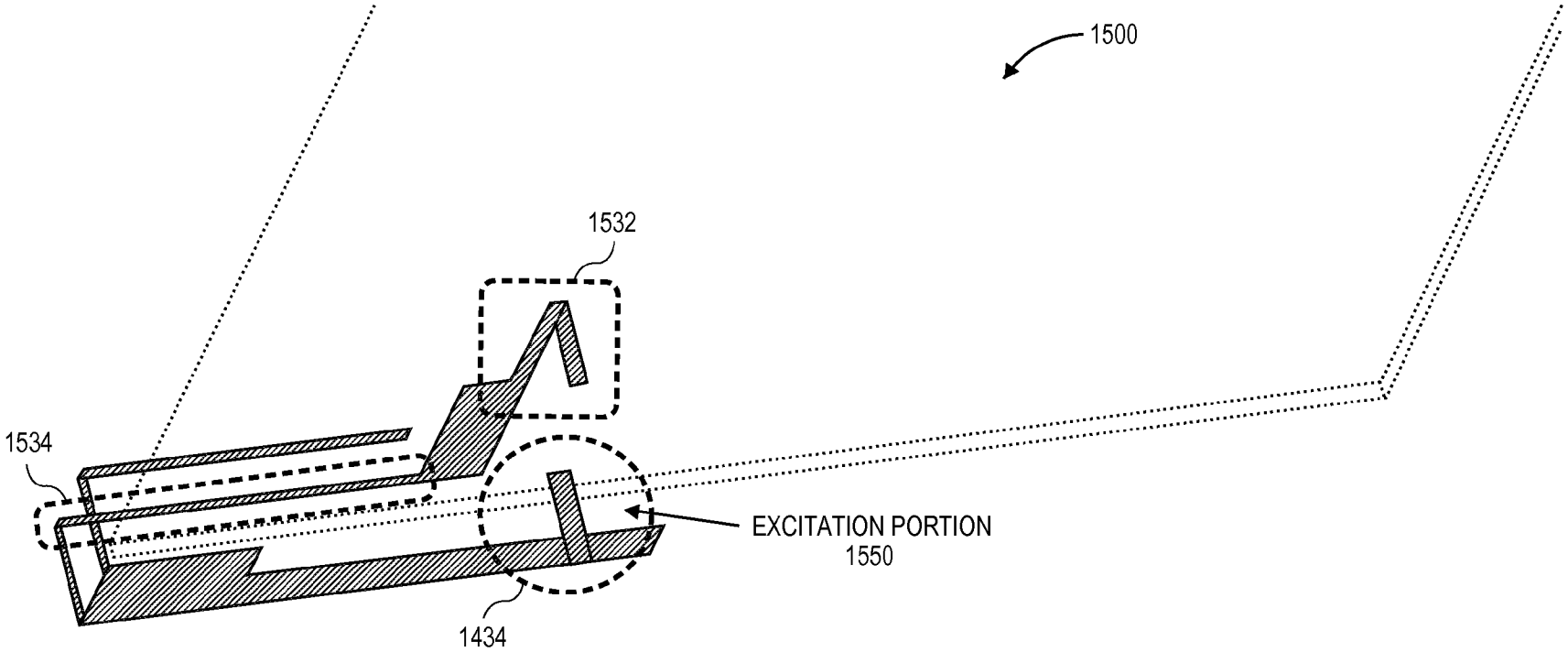
FIG. 15 illustrates one embodiment of an excitation portion for coupling a first antenna structure and a passive antenna structure.

FIG. 15 illustrates one embodiment of an excitation portion 1550 for coupling a first antenna structure and a passive antenna structure. As described above, the excitation portion 1550 is used to electrically couple the first antenna structure and the passive antenna structure. The excitation portion 1550 may have a teeth structure. The dimensions of the teeth structure can be varied to change the resonance mode. In one embodiment, the gaps of the teeth structure can be reduced in width to enable more coupling, shifting down the third resonance, centered at 780 MHz, for example. For example, if the width of one tooth is doubled, the resonance centered at 780 MHz is shifted down by 25 MHz. It should also be noted that the teeth structure is illustrates with three teeth. However, in other embodiments, more or less teeth may be used. The teeth structure can be varied in the number of teeth, the gap size between the teeth, the width, as well as the teeth shape. Alternatively, other variations may be used to produce the same capacitive coupling to enable the circuit mode as would be appreciated by one of ordinary skill in the art having the benefit of this disclosure. In another embodiment, other structures of the passive antenna structure can be varied to change the frequency response of the passive antenna structure. For example, if the lines 1532 and 1534 are reduced in width, the resonances of the third resonant mode (e.g., centered at 780 MHz) can be shifted down.

Figure 16:
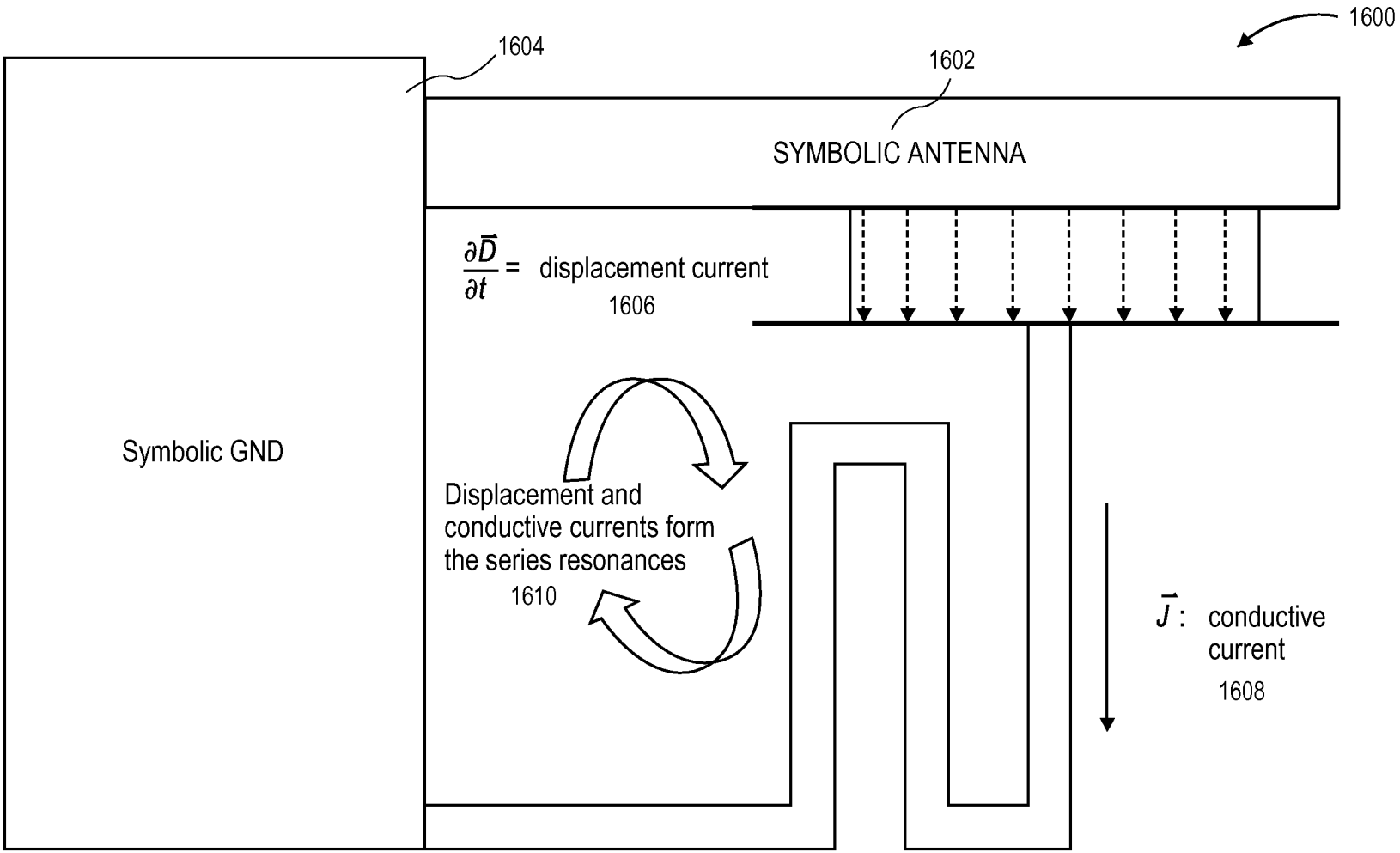
FIG. 16 illustrates a symbolic representation of a circuit mode of a multi-mode wideband antenna according to one embodiment.

FIG. 16 illustrates a symbolic representation of a circuit mode of a multi-mode wideband antenna 1600 according to one embodiment. The multi-mode wideband antenna 1600 can be symbolically represented as a symbolic antenna 1602, a symbolic ground 1604. The symbolic antenna 1602 is driven with a signal at the single RF input. The driven symbolic antenna 1602 creates a displacement current 1606, which induces a conductive current 1608. The displacement and conductive currents form the series resonances 1610 as described above.

Figure 17:
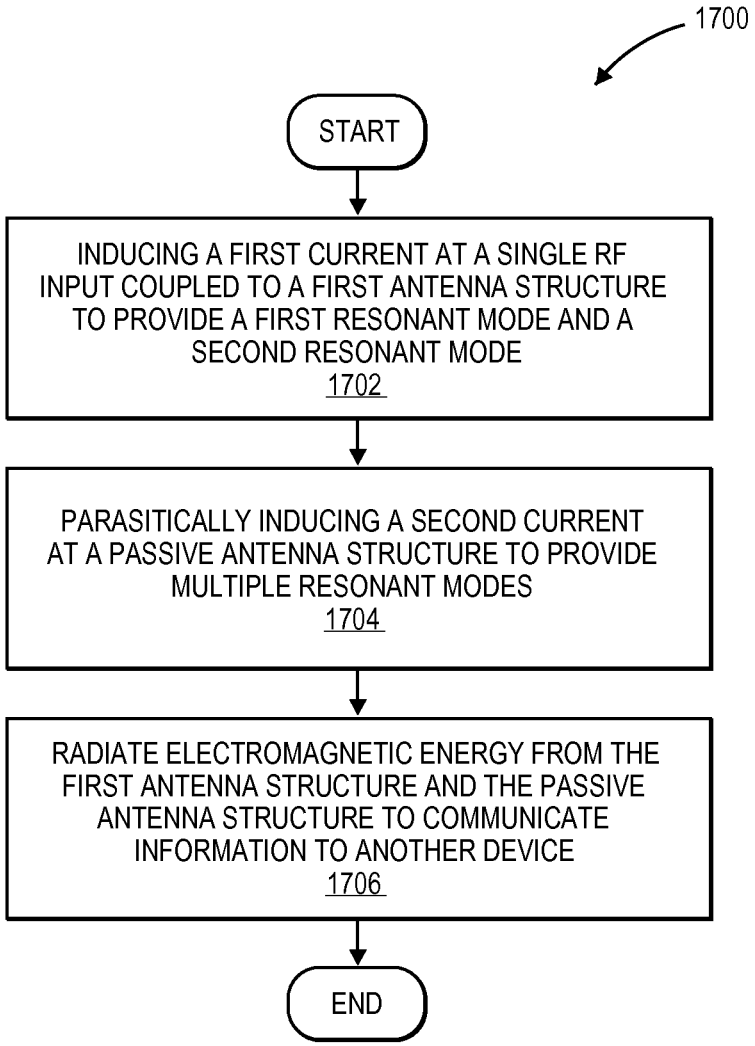
FIG. 17 is a flow diagram of an embodiment of a method of operating a user device having a multi-mode wideband antenna having a dual-mode monopole antenna and a second antenna according to one embodiment.

FIG. 17 is a flow diagram of an embodiment of a method 1700 of operating a user device having a multi-mode wideband antenna having a dual-mode monopole antenna and a second antenna according to one embodiment. In method 1700, a first current is induced at a single radio frequency (RF) input coupled to a first antenna structure (e.g., dual-mode monopole antenna 310) to provide a first resonant mode and a second resonant mode (block 1702). In response, the first antenna structure parasitically induces a second current at a passive antenna structure that is electrically coupled to the first antenna structure, the passive antenna structure to provide multiple resonant modes (block 1704). In response to the induced currents, electromagnetic energy is radiated from the first antenna structure and the passive antenna structure to communicate information to another device (block 1706). The electromagnetic energy forms a radiation pattern. The radiation pattern may be various shapes as would be appreciated by one of ordinary skill in the art having the benefit of this disclosure.

In one embodiment, a current is induced at the RF input, which induces a surface current flow of the dual-mode monopole antenna. The dual-mode monopole antenna parasitically induces a current flow of the second antenna. By inducing current flow at the second antenna, the second antenna increases the bandwidth of the multi-mode wideband antenna, providing additional two or more resonant modes to the resonant mode of the dual-mode monopole antenna. As described herein, the second antenna is physically separated from the dual-mode monopole antenna by a gap.

Figure 18:
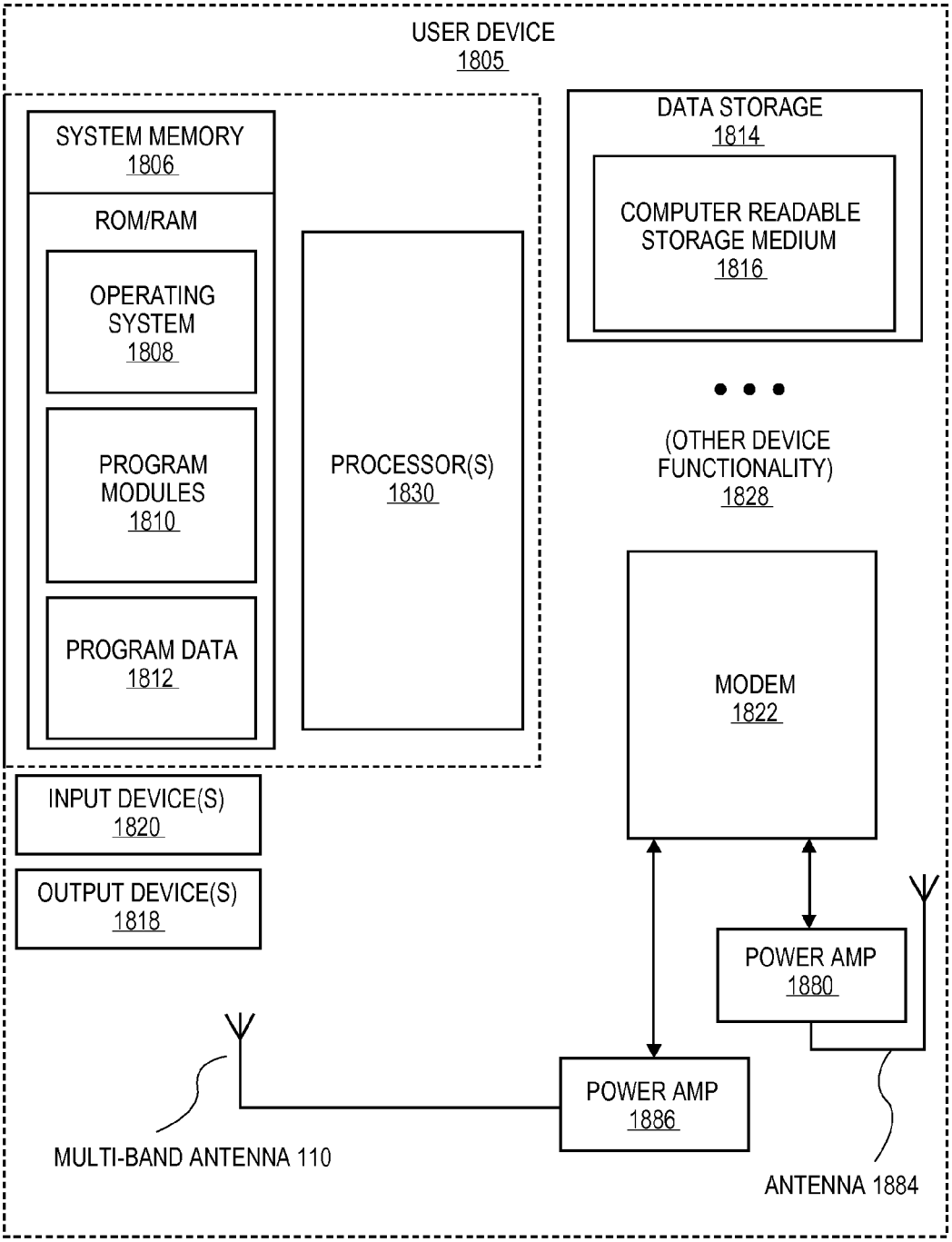
FIG. 18 is a block diagram of a user device having a multi-mode wideband antenna according to one embodiment.

FIG. 18 is a block diagram of a user device 1805 having the multi-mode wideband antenna 100 of FIG. 1 according to one embodiment. The user device 1805 includes one or more processors 1830, such as one or more CPUs, microcontrollers, field programmable gate arrays, or other types of processing devices. The user device 1805 also includes system memory 1806, which may correspond to any combination of volatile and/or non-volatile storage mechanisms. The system memory 1806 stores information which provides an operating system component 1808, various program modules 1810, program data 1812, and/or other components. The user device 1805 performs functions by using the processor(s) 1830 to execute instructions provided by the system memory 1806.

The user device 1805 also includes a data storage device 1814 that may be composed of one or more types of removable storage and/or one or more types of non-removable storage. The data storage device 1814 includes a computer-readable storage medium 1816 on which is stored one or more sets of instructions embodying any one or more of the functions of the user device 1805, as described herein. As shown, instructions may reside, completely or at least partially, within the computer readable storage medium 1816, system memory 1806 and/or within the processor(s) 1830 during execution thereof by the user device 1805, the system memory 1806 and the processor(s) 1830 also constituting computer-readable media. The user device 1805 may also include one or more input devices 1820 (keyboard, mouse device, specialized selection keys, etc.) and one or more output devices 1818 (displays, printers, audio output mechanisms, etc.).

The user device 1805 further includes a wireless modem 1822 to allow the user device 1805 to communicate via a wireless network (e.g., such as provided by a wireless communication system) with other computing devices, such as remote computers, an item providing system, and so forth. The wireless modem 1822 allows the user device 1805 to handle both voice and non-voice communications (such as communications for text messages, multimedia messages, media downloads, web browsing, etc.) with a wireless communication system. The wireless modem 1822 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1xRTT), evaluation data optimized (EVDO), high-speed downlink packet access (HSDPA), WiFi, etc. In other embodiments, the wireless modem 1822 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1805 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1805 to communicate with other devices, such as other user devices, server computing systems, telephone devices, or the like. In addition to wirelessly connecting to a wireless communication system, the user device 1805 may also wirelessly connect with other user devices. For example, user device 1805 may form a wireless ad hoc (peer-to-peer) network with another user device.

The wireless modem 1822 may generate signals and send these signals to power amplifier (amp) 1880 or power amp 1886 for amplification, after which they are wirelessly transmitted via the multi-mode wideband antenna 100 or antenna 1884, respectively. Although FIG. 18 illustrates power amps 1880 and 1886, in other embodiments, a transceiver may be used to all the antennas 110 and 1884 to transmit and receive. The antenna 1884, which is an optional antenna that is separate from the multi-mode wideband antenna 100, may be any directional, omnidirectional, or non-directional antenna in a different frequency band than the frequency bands of the multi-mode wideband antenna 100. The antenna 1884 may also transmit information using different wireless communication protocols than the multi-mode wideband antenna 100. In addition to sending data, the multi-mode wideband antenna 100 and the antenna 1884 also receive data, which is sent to wireless modem 1822 and transferred to processor(s) 1830. It should be noted that, in other embodiments, the user device 1805 may include more or less components as illustrated in the block diagram of FIG. 18.

In one embodiment, the user device 1805 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the multi-mode wideband antenna 100 that operates at a first frequency band and the second wireless connection is associated with a second resonant mode of the multi-mode wideband antenna 100 that operates at a second frequency band. In another embodiment, the first wireless connection is associated with the multi-mode wideband antenna 100 and the second wireless connection is associated with the antenna 1884. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1822 is shown to control transmission to both antennas 110 and 1884, the user device 1805 may alternatively include multiple wireless modems, each of which is configured to transmit/receive data via a different antenna and/or wireless transmission protocol. In addition, the user device 1805, while illustrated with two antennas 110 and 1884, may include more or fewer antennas in various embodiments.

The user device 1805 delivers and/or receives items, upgrades, and/or other information via the network. For example, the user device 1805 may download or receive items from an item providing system. The item providing system receives various requests, instructions, and other data from the user device 1805 via the network. The item providing system may include one or more machines (e.g., one or more server computer systems, routers, gateways, etc.) that have processing and storage capabilities to provide the above functionality. Communication between the item providing system and the user device 1805 may be enabled via any communication infrastructure. One example of such an infrastructure includes a combination of a wide area network (WAN) and wireless infrastructure, which allows a user to use the user device 1805 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 1805.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1805 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1805 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A apparatus comprising:

a single radio frequency (RF) input;

a dual-mode monopole antenna coupled to the single RF input, wherein the dual-mode monopole antenna is configured to provide a first resonant mode and a second resonant mode and to operate as a feeding structure to an antenna circuit that is not conductively connected to the dual-mode monopole antenna; and the antenna circuit configured to provide a plurality of resonant modes, wherein the antenna circuit comprises:

a line structure coupled to ground;

a strip coupled to the line structure; and a second folded arm extending back towards the line structure from a distal end of the strip, wherein the strip is disposed in parallel with a first arm of the dual-mode monopole antenna and farther away from the single RF input than the first arm, and wherein the strip is disposed to form a gap between a portion of the first arm and a portion of the strip.

2. The apparatus of claim 1, wherein the dual-mode monopole antenna is a first monopole with folded arms.

3. The apparatus of claim 2, wherein the first monopole with folded arms comprises:

a base coupled to the single RF input;

the first arm extending out from a first side of the base; and a first folded arm extending back towards the first side of the base from a distal end of the first arm.

4. The apparatus of claim 3, wherein the first arm is configured to provide the first resonant mode and the first folded arm is configured to provide the second resonant mode.

5. The apparatus of claim 1, wherein the strip is configured to operate as at least a portion of a capacitor of the antenna circuit, and wherein the line structure is configured to operate as at least a portion of an inductor of the antenna circuit.

6. The apparatus of claim 1, wherein one or more portions of the dual-mode monopole antenna and antenna circuit are disposed on a three-dimensional antenna carrier to reduce an overall effective height of the apparatus.

7. The apparatus of claim 2, wherein the first monopole with folded arms is configured to provide the first resonant mode and the first folded arm is configured to provide the second resonant mode, and wherein the strip is configured to provide a third resonant mode of the plurality of resonant modes and the second folded arm is configured to provide a fourth resonant mode of the plurality of resonant modes.

8. The apparatus of claim 7, wherein the first resonant mode is in a range between 680 MHz and 1240 MHz, the second resonant mode is in a range between 1.6 GHz and 2.0 GHz, the third resonant mode is in a range between 715 MHz and 845 MHz, and the fourth resonant mode is in a range between 1.91 GHz and 2.43 GHz.

9. The apparatus of claim 7, wherein an order of frequencies of the first, second, third, and fourth resonant modes from lowest frequency to highest frequency is the third resonant mode, the first resonant mode, the second resonant mode, and the fourth resonant mode.

10. A apparatus, comprising:

a single radio frequency (RF) input;

a first antenna structure coupled to the single RF input, wherein the first antenna structure is configured to provide a first resonant mode and a second resonant mode and to operate as a feeding structure to a passive antenna structure that is not conductively connected to the first antenna structure; and the passive antenna structure coupled to ground, wherein the passive antenna structure is configured to create a third resonant mode that is less than the first resonant mode and to create one or more additional resonant modes.

11. The apparatus of claim 10, wherein the passive antenna structure comprises a first element to form a capacitor between the passive antenna structure and the first antenna structure and a second element to form an inductor between the passive antenna structure and the first antenna structure.

12. The apparatus of claim 10, wherein the passive antenna structure is configured to form series inductance capacitance (LC) resonances in a circuit mode.

13. The apparatus of claim 10, further comprising:

a ground plane coupled to the passive antenna structure; and an antenna carrier upon which the first antenna structure and the passive antenna structure are disposed, wherein the antenna carrier, the first antenna structure, and the passive antenna structure are three dimensional.

14. The apparatus of claim 13, wherein the first antenna structure and the passive antenna structure are disposed to wrap around at least two sides of the antenna carrier.

15. The apparatus of claim 13, wherein the first antenna structure and the passive antenna structure are disposed to wrap around all six sides of the antenna carrier.

16. The apparatus of claim 10, further comprising an excitation portion to electrically couple the first antenna structure and the passive antenna structure.

17. The apparatus of claim 16, wherein the excitation portion comprises one or more elements coupled to the first antenna structure and one or more elements coupled to the passive antenna structure, wherein the one or more elements of the first antenna structure and the one or more elements of the passive structure are interdigitated.

18. An apparatus comprising:

a single radio frequency (RF) input;

a first antenna structure coupled to the single RF input, wherein the first antenna structure is configured to provide a first resonant mode and a second resonant mode and to operate as a feeding structure to a passive antenna structure that is not conductively connected to the first antenna structure; and the passive antenna structure coupled to ground, wherein the passive antenna structure is configured to create a third resonant mode that is less than the first resonant mode and to create one or more additional resonant modes, wherein the first antenna structure comprises a first monopole with folded arms coupled to the single RF input at a first end and coupled to a ground plane at a second end.

19. The apparatus of claim 18, wherein the first monopole with folded arms comprises:

a first base coupled to the single RF input, the first base extending from the single RF input towards a top side of an antenna carrier;

a first arm extending out from a first side of the first base on a front side of the antenna carrier towards a first side of the antenna carrier and wrapping around the first side of the antenna carrier to the top side of the antenna carrier;

a first folded arm, coupled to the first arm, extending back towards the first side of the first base on the top side of the antenna carrier;

a second base coupled to the ground plane, the second base extending from the ground plane towards the top side of the antenna carrier, wherein the second base is disposed parallel with the first base and closer to the first side of the antenna carrier than the first base;

a second arm extending from a first side of the second base on the front side of the antenna carrier towards the first side of the antenna carrier, and wrapping around the first side of the antenna carrier to the top side of the antenna carrier;

a second folded arm, coupled to the second arm, extending back towards the first side of the second base on the top side of the antenna carrier, wherein the first folded arm at the top side of the antenna carrier is disposed closer to the front side of the antenna carrier than the second folded arm; and a first coupling portion disposed at the top side of the antenna carrier to couple a distal end of the first folded arm to a distal end of the second folded arm.

20. The apparatus of claim 19, wherein the first arm is configured to provide the first resonant mode and the second arm is configured to provide the second resonant mode.

21. The apparatus of claim 20, wherein the first resonant mode is in a range between 680 MHz and 1.240 GHz and the second resonant mode is in a range between 1.6 GHz and 2.0 GHz.

22. The apparatus of claim 21, further comprising a second coupling portion disposed at the front side of the antenna carrier to couple a portion of the first arm that extends from the first side of the first base to the first side of the antenna carrier and a portion of the second arm that extends from the first side of the second base to the first side of the antenna carrier.

23. A apparatus comprising:

a single radio frequency (RF) input;

a first antenna structure coupled to the single RF input, wherein the first antenna structure is configured to provide a first resonant mode and a second resonant mode and to operate as a feeding structure to a passive antenna structure that is not conductively connected to the first antenna structure; and the passive antenna structure coupled to ground, wherein the passive antenna structure is configured to create a third resonant mode that is less than the first resonant mode and to create one or more additional resonant modes, wherein the passive antenna structure comprises a three-dimensional (3D) closed loop structure coupled to a ground plane at a first end.

24. The apparatus of claim 23, wherein the 3D closed loop structure comprises:

a first base coupled to the ground plane, the first base extending from the ground plane towards a top side of an antenna carrier;

a first arm extending out from a first side of the first base on a front side of the antenna carrier towards a second side of the antenna carrier, and wrapping around the second side of the antenna carrier to a back side of the antenna carrier; and a first folded arm extending back towards the first side of the first base on the back side of the antenna carrier.

25. The apparatus of claim 24, wherein the 3D closed loop structure further comprises a second arm wrapping around the second side of the antenna carrier from a portion of first folded arm disposed on the back side of the antenna carrier, extending towards the front side of the antenna carrier, and extending back towards the first side of the first base on the front side of the antenna carrier.

26. The apparatus of claim 25, wherein the first base and the first arm are configured to provide the third resonant mode and a fourth resonant mode of the one or more additional resonant modes, and wherein the second arm is configured to provide a fifth resonant mode of the one or more additional resonant modes.

27. The apparatus of claim 26, wherein the first resonant mode is in a range between 680 MHz and 1240 MHz, the second resonant mode is in a range between 1.6 GHz and 2.0 GHz, the third resonant mode is in a range between 715 MHz and 845 MHz, the fourth resonant mode is in a range between 1.91 GHz and 2.43 GHz, and the fifth resonant mode is in a range between 1.81 GHz and 2.13 GHz.

28. The apparatus of claim 24, wherein the first base, first arm, and first folded arm are configured to provide the third resonant mode and a fourth resonant mode of the one or more additional resonant modes.

29. The apparatus of claim 28, wherein the first resonant mode is in a range between 680 MHz and 1240 MHz, the second resonant mode is in a range between 1.6 GHz and 2.0 GHz, the third resonant mode is in a range between 715 MHz and 845 MHz, and the fourth resonant mode is in a range between 1.91 GHz and 2.43 GHz.

30. A user device comprising:

a wireless modem; and a multi-mode antenna configured to radiate electromagnetic energy to communicate data to and from the wireless modem via a single radio frequency (RF) input coupled to the wireless modem, wherein the multi-mode antenna comprises:

a first antenna structure coupled to the single RF input, wherein the first antenna structure is configured to provide a first resonant mode and a second resonant mode and to operate as a feeding structure to a passive antenna structure that is not conductively connected to the first antenna structure; and the passive antenna structure configured to create a third resonant mode, a fourth resonant mode, and a fifth resonant mode.

31. The user device of claim 30, further comprising a transceiver coupled to the wireless modem and the single RF input.

32. The user device of claim 30, wherein the first resonant mode is in a range between 680 MHz and 1240 MHz, the second resonant mode is in a range between 1.6 GHz and 2.0 GHz, the third resonant mode is in a range between 715 MHz and 845 MHz, and wherein the one or more additional resonant modes comprises a fourth resonant mode that is in a range between 1.91 GHz and 2.43 GHz.

33. The user device of claim 30, wherein the first resonant mode is in a range between 680 MHz and 1240 MHz, the second resonant mode is in a range between 1.6 GHz and 2.0 GHz, the third resonant mode is in a range between 715 MHz and 845 MHz, and wherein the fourth resonant mode is in a range between 1.91 GHz and 2.43 GHz, and the fifth resonant mode is in a range between 1.81 GHz and 2.13 GHz.

34. The user device of claim 30, wherein an order of frequencies of the first, second, third, fourth, and fifth resonant modes from lowest frequency to highest frequency is the third resonant mode, the first resonant mode, the second resonant mode, the fifth resonant mode, and the fourth resonant mode.

35. The use device of claim 30, wherein the multi-mode antenna is disposed on a dielectric carrier in two dimensions.

36. The use device of claim 30, wherein the multi-mode antenna is disposed on a dielectric carrier in three dimensions.

37. A user device comprising:

a wireless modem; and a multi-mode antenna configured to radiate electromagnetic energy to communicate data to and from the wireless modem via a single radio frequency (RF) input coupled to the wireless modem, wherein the multi-mode antenna comprises:

a first antenna structure coupled to the single RF input, wherein the first antenna structure is configured to provide a first resonant mode and a second resonant mode and to operate as a feeding structure to a passive antenna structure that is not conductively connected to the first antenna structure; and the passive antenna structure configured to create a third resonant mode and one or more additional resonant modes, wherein the multi-mode antenna further comprises an excitation portion that electrically couples the first antenna structure and the passive antenna structure, wherein the first antenna structure and the passive antenna structure are not conductively connected.

38. The user device of claim 37, wherein the excitation portion comprises one or more elements coupled to the first antenna structure and one or more elements coupled to the passive antenna structure, wherein the elements of the first antenna structure and the passive structure are interdigitated.

39. A method of operating a user device, the method comprising:

inducing a first current at a single radio frequency (RF) input coupled to a first antenna structure of a multi-mode antenna to provide a first resonant mode and a second resonant mode;

in response, parasitically inducing a second current at a passive antenna structure of the multi-mode antenna to provide a third resonant mode that is less than the first resonant mode and one or more additional resonant modes; and radiating electromagnetic energy from the first antenna structure and the passive antenna structure to communicate information to another device in response to the first and second currents.

40. The method of claim 39, wherein the first resonant mode is in a range between 680 MHz and 1240 MHz, the second resonant mode is in a range between 1.6 GHz and 2.0 GHz, the third resonant mode is in a range between 715 MHz and 845 MHz, and wherein the one or more additional resonant modes comprises a fourth resonant mode that is in a range between 1.91 GHz and 2.43 GHz.

41. The method of claim 39, wherein the first resonant mode is in a range between 680 MHz and 1240 MHz, the second resonant mode is in a range between 1.6 GHz and 2.0 GHz, the third resonant mode is in a range between 715 MHz and 845 MHz, and wherein the one or more additional resonant modes comprise a fourth resonant mode that is in a range between 1.91 GHz and 2.43 GHz, and a fifth resonant mode is in a range between 1.81 GHz and 2.13 GHz.

* * * * *